US011401638B2

(12) United States Patent
Huffa et al.

(10) Patent No.: US 11,401,638 B2
(45) Date of Patent: Aug. 2, 2022

(54) METHOD OF KNITTING A WARP STRUCTURE ON A FLAT KNITTING MACHINE

(71) Applicant: Fabdesigns, Inc., Malibu, CA (US)

(72) Inventors: Bruce Huffa, Encino, CA (US); Concetta Maria Huffa, Encino, CA (US)

(73) Assignee: FABDESIGNS, INC., Malibu, CA (US)

( * ) Notice: Subject to any disclaimer, the term of this patent is extended or adjusted under 35 U.S.C. 154(b) by 65 days.

(21) Appl. No.: 16/418,814

(22) Filed: May 21, 2019

(65) Prior Publication Data

US 2019/0360134 A1 Nov. 28, 2019

Related U.S. Application Data

(60) Provisional application No. 62/674,622, filed on May 22, 2018.

(51) Int. Cl.
*D04B 15/56* (2006.01)

(52) U.S. Cl.
CPC ..... *D04B 15/56* (2013.01)

(58) Field of Classification Search
CPC ..... D04B 15/56; D04B 15/565
USPC ..... 66/126 R, 128
See application file for complete search history.

(56) References Cited

U.S. PATENT DOCUMENTS 1,712,344 A 5/1929 Graeber
1,828,533 A 10/1931 Hoffmann
2,294,916 A 9/1942 Kretser
RE24,737 E 11/1959 Bolles et al.
3,572,056 A * 3/1971 Radin ..... D04B 15/327 66/57
3,733,856 A 5/1973 Masahiro
(Continued)

FOREIGN PATENT DOCUMENTS

DE 3634307 A1 * 1/1988 ..... D04B 23/12
DE 3937406 5/1991
(Continued)

OTHER PUBLICATIONS

"Swing English Definition and Meaning." Lexico Dictionaries | English, Lexico Dictionaries, https://www.lexico.com/en/definition/swing?locale=en. (Year: 2021).*
(Continued)

*Primary Examiner* — Khoa D Huynh
*Assistant Examiner* — Grace Huang
(74) *Attorney, Agent, or Firm* — Garson & Gutierrez, PC

(57) ABSTRACT

System and method of manufacturing a unitary construction of a weft knit article with one or more warp insert in an integrated knitting process by using a weft knit machine. The unitary construction comprises one or more yarn materials which are incorporated into one or more weft and warp stitch structures. The knitting machine is equipped with a warp feeder assembly, including a weft knit warp feeder, a warp knitting guide needle block operable to hold a plurality of warp strands, a strand guide bar configured to guide the plurality of warp strands to the weft knit warp feeder, and a cam box. The cam box includes at least a weft stitch cam, a weft guard cam, a warp stitch cam, and a warp guard cam.

21 Claims, 29 Drawing Sheets

(56) References Cited

U.S. PATENT DOCUMENTS

| | | | | | |
|---|---|---|---|---|---|
| 3,859,824 | A * | 1/1975 | Krylov | D04B 15/80 | 66/10 |
| 3,916,648 | A * | 11/1975 | Betts | D04B 15/362 | 66/75.1 |
| 3,992,903 | A | 11/1976 | Janda et al. | | |
| 4,122,555 | A | 10/1978 | Safrit et al. | | |
| 4,237,706 | A * | 12/1980 | Patthey | D04B 7/26 | 66/126 R |
| 4,244,197 | A * | 1/1981 | Althammer | D04B 1/123 | 66/19 |
| 4,294,085 | A * | 10/1981 | Trautner | D04B 15/365 | 66/75.1 |
| 4,748,078 | A | 5/1988 | Doi et al. | | |
| 5,305,620 | A * | 4/1994 | Yabuta | D04B 15/10 | 66/109 |
| 5,517,832 | A | 5/1996 | Kristensen | | |
| 5,615,562 | A * | 4/1997 | Roell | D04B 15/565 | 66/126 R |
| 6,854,200 | B2 | 2/2005 | Hipp et al. | | |
| 6,986,269 | B2 | 1/2006 | Dua | | |
| 7,555,921 | B2 * | 7/2009 | Thompson | A41D 19/0096 | 2/159 |
| 7,757,515 | B1 * | 7/2010 | Starbuck | D04B 9/12 | 66/92 |
| 8,448,474 | B1 | 5/2013 | Tatler et al. | | |
| 8,522,577 | B2 * | 9/2013 | Huffa | D04B 7/04 | 66/127 |
| 8,973,410 | B1 | 3/2015 | Podhajny | | |
| 9,149,086 | B2 | 10/2015 | Greene et al. | | |
| 9,226,540 | B2 * | 1/2016 | Podhajny | D04B 1/22 | |
| 9,549,591 | B2 | 1/2017 | Uchikawa et al. | | |
| 9,661,892 | B2 | 5/2017 | Meir | | |
| 9,771,673 | B2 | 9/2017 | Ikenaka et al. | | |
| 10,233,574 | B2 * | 3/2019 | Wan | D04B 15/80 | |
| 10,294,591 | B2 | 5/2019 | Podhajny et al. | | |
| 10,753,019 | B2 | 8/2020 | Berrian et al. | | |
| 10,900,153 | B2 * | 1/2021 | Couderc | D04B 21/12 | |
| 10,939,729 | B2 * | 3/2021 | Tamm | A43B 23/0275 | |
| 11,053,614 | B2 * | 7/2021 | Stewart | F16J 15/065 | |
| 2014/0134378 | A1 | 5/2014 | Downs et al. | | |
| 2016/0029736 | A1 | 2/2016 | Meir | | |
| 2016/0075061 | A1 | 3/2016 | Waas et al. | | |
| 2016/0369436 | A1 * | 12/2016 | Stewart | F16J 15/027 | |
| 2017/0176146 | A1 | 6/2017 | Bohringer et al. | | |
| 2018/0002133 | A1 | 1/2018 | Stewart et al. | | |
| 2018/0055145 | A1 | 3/2018 | Aristizabal et al. | | |
| 2018/0184755 | A1 | 7/2018 | Yumiba et al. | | |
| 2018/0303204 | A1 | 10/2018 | Woodard | | |
| 2018/0343956 | A1 | 12/2018 | Li et al. | | |
| 2018/0343973 | A1 | 12/2018 | Hancock | | |
| 2019/0153639 | A1 | 5/2019 | Nishigaki | | |
| 2019/0203389 | A1 | 7/2019 | Liu | | |
| 2019/0231021 | A1 | 8/2019 | Hoying et al. | | |
| 2019/0233988 | A1 | 8/2019 | Harada et al. | | |
| 2019/0328075 | A1 | 10/2019 | Poulsen et al. | | |
| 2019/0352816 | A1 * | 11/2019 | Huffa | B65H 49/20 | |

FOREIGN PATENT DOCUMENTS

| | | | | |
|---|---|---|---|---|
| DE | 4439907 | | 5/1996 | |
| EP | 0061975 | | 10/1982 | |
| EP | 0526406 | | 2/1993 | |
| EP | 1298239 | | 2/2003 | |
| EP | 2960362 | | 12/2013 | |
| EP | 3412814 | | 12/2018 | |
| EP | 3569750 | | 11/2019 | |
| FR | 598096 | A * | 12/1925 | D04B 15/58 |
| FR | 2149520 | | 8/1972 | |
| GB | 720687 | | 12/1954 | |
| GB | 2214939 | | 9/1989 | |
| TW | M547866 | U | 1/2017 | |
| WO | WO-8808892 | A1 * | 11/1988 | D04B 15/565 |
| WO | WO2010142608 | | 12/2010 | |
| WO | WO2011043998 | | 4/2011 | |
| WO | WO2015134648 | | 9/2015 | |
| WO | WO2016144971 | | 9/2016 | |
| WO | WO-2020257078 | A1 * | 12/2020 | D04B 15/56 |

OTHER PUBLICATIONS

Gupta, B.S., and M. Afshari, "Tensile Failure of Polyacrylonitrile Fibers." Handbook of Tensile Properties of Textile and Technical Fibres, Woodhead Publishing, Mar. 27, 2014, www.sciencedirect.com/science/article/pii/B978184569387950014X?via%3Dihub. (Year: 2014).

* cited by examiner side view

METHOD OF KNITTING A WARP STRUCTURE ON A FLAT KNITTING MACHINE

CROSS-REFERENCE TO RELATED APPLICATION

This patent application claims priority and benefit of U.S. Provisional Patent Application No. 62/674,622, entitled "METHOD FOR INTRODUCING A WARP STRUCTURE TO A FLAT KNITTING MACHINE," filed on May 22, 2018, the entire content of which is herein incorporated by reference for all purposes.

TECHNICAL FIELD

Embodiments of the present disclosure relate generally to textile knitting technologies, and more specifically, to the field of knitting mechanisms on flat-bed knitting machinery.

BACKGROUND OF THE INVENTION

Reinforcement materials can be made by weft knitting and act to support another material, or restrict stretch, or dampen vibration, or add ligamental stretch and recovery, insulate an energy or data transmitting cable and/or auxetic materials in the vertical and/or multiple directions. Conventional methods of manufacturing reinforcement materials require post processes and additional materials to be applied to the weft knitted material, additional bonding, adhesives and/or seams. These post processes are usually manual operations. Reinforcing or supporting weft knitted materials in more than one direction, in opposing diagonal directions, and/or changing directions of support in a weft knitted fabric require additional finishing, resulting in seams and/or multiple layers. Seams create failure points, placement errors, adhesive and/or bonding irregularities. In the case of knitting Teflon® (polytetrafluoroethylene), Kevlar® (poly-paraphenylene terephthalamide (K29)), carbon fiber, stainless steel, composites or other stiff fibers that resist bonding and/or adhesives, this problem is increased, and in most cases a mechanical means of attaching support is required. Layers create thick spots and the addition of layers creates a heavier product than that of a single layer material.

Efforts have previously been made to produce weft knitted fabric which has the dimensional stability and other characteristics of woven fabric. Warp knitting machinery with weft insertions has the ability to create very stable fabric at high rates of production. However, the resulting material is rectangular in shape and limited to having woven selvages. Efforts have also previously been made to produce weft knitted fabric which has the dimensional stability and other characteristics of woven fabric by permanently altering a V-bed weft knitting machine, by permanently modifying the needle beds and creating a single section of a warp structure. As a result, the modified machine is limited to manufacturing one fabric orientation, and the produced fabrics are limited to travel in only the modified segment of the needle bed and in only the warp direction. All strands are warp insert in nature and travel in the same direction.

Weft knitting, specifically flat V-bed knitting offers an almost limitless variety of structures and combinations of materials, including knitting those materials to shape in two-dimensions and three-dimensions. However, adding a warp fabric element on a flat knitting (V-bed) machine poses significant difficulties, including challenges in providing a weft knit warp element for top feeding strands into the machine, essentially creating the effect of a warp. The Stoll ADF electronic knitting machines and the Steiger Aries knitting machines have vertically fed yarns. If grouped together, the yarn feeders can in effect make one small warp effect, using all available feeders. However, parking feeders close enough to one another to create focused stable structure is not practical. There is also a problem of a limited number of feeders available, e.g., sixteen to a maximum thirty-two, to which one or more must be designated to knit the base material.

Current methods of knitting carbon fiber and other fiber reinforcing textiles, such as integrating stainless steel, wire, heating elements, chain, fiber optic, auxetic, thermo coupling wires, braids, aramids, para aramids, chain, basalt, insulated fiber optics, insulated wire, silicon rubber, ceramic, vitreous silica, or other specialized materials, pose challenges to the "de-packaging" and feeding of those materials into a conventional knitting machine utilizing standard OEM stop motions and standard OEM feeders. Currently, the only practical alternative is using one of two unspooling devices from either of two machine builders, depending on which machine type the user is utilizing, and then only two devices mounted on supplemental racking systems to the side of the machine. This limits the number of strands of these specialized materials that can be used in a warp structure and to two feeders.

The terms "V-bed knitting" and "weft knitting" are used to describe the construction of fabric by feeding yarn and forming loops in the horizontal ("weft") direction. FIG. 1 illustrates the interplay between the needles and strands in forming a fabric in weft knitting. FIG. 2 illustrates a side view of a two-needle bed weft knitting machine. FIG. 3 illustrates a side view of a four-needle bed weft knitting machine. FIG. 4 illustrates a side view of a four-needle bed weft knitting machine with a fabric exiting the machine.

Using a weft V-bed knitting machine to create a fabric 4 basically involves drawing strands of yarn 3, into needles 5, and using the needles to interloop the strands. A V-bed weft knitting machine shown in FIG. 2 typically has at least two opposing needle beds 6, which are positioned at an angle resembling a V. Each bed 6 has a set of needles 5. FIG. 3 shows a 4-needle bed machines with two auxiliary or alternate beds 8. There are fashioning points 7 or additional needles that allow for relocating stitches from the V-beds 6 to another location or adding additional stitches. As shown in FIG. 4, loops are progressively built up in a fabric by converting the new yarn strands 3 fed into in the needle to create new rows of loops ("courses"). In this way, each stitch is a wale.

Yarn 3 is fed into the machine by automatically pulling a plurality of strands of yarns or other materials off a plurality of cones 9, or packages with the movement of the knitting machine feeders 10 introducing yarn into the needles 5. Several feeders 10 are located on each machine and run along rails 11 in a horizontal direction. The feeders 10 of some types of V-bed knitting machines (such as the Stoll CMS ADF V-bed knitting machine) are independent and individually controlled "autarkic" motorized feeders. The machine is capable of standard multiple OEM functions, knitting, floating, inlaying, intarsia, plaiting, and tucking in the same machine pass. FIG. 5 shows an autarkic feeder.

FIG. 6 shows a front view of a V-bed knitting machine. Other more common weft knitting machine models, such as the Stoll CMS 530 HP V-Bed knitting machine, have strands pulled from cones 9, through one or more yarn guides 17, into standard OEM stop motions 13, on an OEM bar, to side positive feed devices 14, into side tensioning devices 15, along the yarn feeder rails 11, into yarn feeders 10, and into needles 5 which are activated by the cam box 12 and the cam box ride along the needle bed 6. The strands 3 run through the feeders 10 and are manipulated by both the feeders 10 along the length of a pre-programmed length of the needle bed 6 also in the horizontal (weft) direction, while the cam box 12 travels the length of the needle beds 6 activating the knitting needles 5 to act in interlacing of the strands 3 into loops of fabric 4. The resulting fabric 4 exits the machine under the needle beds.

An electronic weft V-bed knitting machine can be programmed to automatically select the needles and other elements via mechanical and/or digital instruction processes. FIG. 7 shows parts of a knitted loop or a stitch. In forming loops, the strands bend around the knitting needles 5 and form a small dynamic arch, which can be broken down into its parts. The head 18 is usually visible in the technical face 1 of a fabric, the feet 19 are usually visible on the technical back 2, or purl side of a fabric; the legs 20 stabilize the head 18 and feet 19, suspending them in the fabric, and linking it to other adjacent loops. The legs 20 also stabilize any materials which are inlaid 21 into the fabric. There are traditionally two types of inlay in traditional weft knitted V-bed fabrics, single jersey 22 inlay, where loops from a single bed fabric are transferred temporarily to the rear bed, and one or more strands travel together 21, passing between loops on the front and rear beds in one or more traverses of the knitting machine. After a desired amount of materials are inserted (inlaid), the loops that were temporarily transferred to the rear bed are then deposited back into the front bed in their original position, or in another desired position. In double bed fabric 23, the inlayed strand(s) 21 pass between an arrangement of loops on both the front bed 24 and the rear bed 25. After the desired amount of inlaid materials 21 are inserted (inlaid), another row (course) of loops is added in a desired knitting structure.

Modern V-bed flat knitting machines are designed to move only where needed to digitally select and knit, or where required to move yarn feeders in the fabric for plaiting, intarsia, striping, jacquard, fully fashioning, flesage (wedge-knitting), short-rowing, inlay, and other techniques. For typical yarn constructions on standard packaging, the machines are designed to keep up with the erratic motion of a V-bed machine knitting back and forth, many times varying the width of the fabric piece, by an electronic stop motion system. FIG. 8 shows a left view of an OEM stop motion according to the conventional art. FIG. 9 shows a left view of the OEM stop motion. FIG. 10 shows a bottom view of the OEM stop motion.

As shown in FIG. 8, the stop motion has a metalized spring arm 26 with a pot eye 27 at the end to thread material strands, that when there is too much slack on the material strand 3 or the material breaks, the metalized spring arm raises to meet an internal electrified wire to create a circuit that stops the machine abruptly. This spring arm action halts materials being pulled and the entire knitting process. The spring arm action activates if the strand breaks. The feeders are mounted on a stock OEM bar 28 above the needle beds and have built in manual tensioning controls 29. In FIG. 9, a secondary mechanical action occurs with a metal strip 33 that rides along the strand in the stop motion assembly and is triggered by linear irregularity in the material or in the case if there is a knot sensed in the cymbal guides 30. As long as a minimum tension is continuously applied to the material 3 feeding through the yarn guides 31 and stop motions, and there are no sensed linear defects, the stop sensors will not be activated. The tensions in most stop motion assemblies are adjustable though a series of mechanical spring-loaded dials 29 that apply torque tension on the spring arm 26, the cymbal pressure 30, and the sensitivity of the knot catchers 33. In FIG. 9, the stock OEM bar 28 has an electronic cable 32 inside a groove, which connects each stop motion to a computer control system.

A stiff material, such as would be integrated in a weft knit warp structure, must bend several times through multiple right, obtuse, and acute angles (e.g., shown in FIG. 10). As it passes through these standard OEM fittings and guides 31, a significant amount of friction results in static building up, which can cause damage to machine computers and other machine electronics, breakage of fiber, excessive wear on the machine parts, drag of fiber slowing down production, and many other complications. When a material is deployed from a cone to the device, the material tends to balloon on itself and spiral into a coil. After several revolutions, the spiraling process can create a graduated spring in the fabric and in the slack strand, which is undesirable itself. A strand of specialized material twisting upon itself can cause fiber breakage, excess friction and abrasion on the machine parts that touch the fibers, and finally breaking of the strand itself. Breakage can usually not be mended on the strand and/or the fabric growing in the machine, and can result in waste scrap, production down time, damaged product, frequently damaged machine parts, needles, stop motions, knock over verges, sinkers, sinker, wires and other costly machine parts. In addition, these stop motion devices take up considerable space on a knitting machine, and greatly limit the number of stop motions and in turn materials available for a weft knit warp structure element. The angle of delivery of strands from a stop motion to a feeder is also critical for the weft knit warp element to be successfully achieved, and reduction of drag and friction on machine parts as it travels to the feeder 10 and into the knitting needles 5.

BRIEF DESCRIPTION OF THE DRAWINGS

The embodiments can be better understood with reference to the following drawings and description. The components in the figures are not necessarily to scale, emphasis instead being placed upon illustrating the principles of the embodiments. Moreover, in the figures, like reference numerals designate corresponding parts throughout the different views.

SUMMARY OF THE INVENTION

Figure 1:
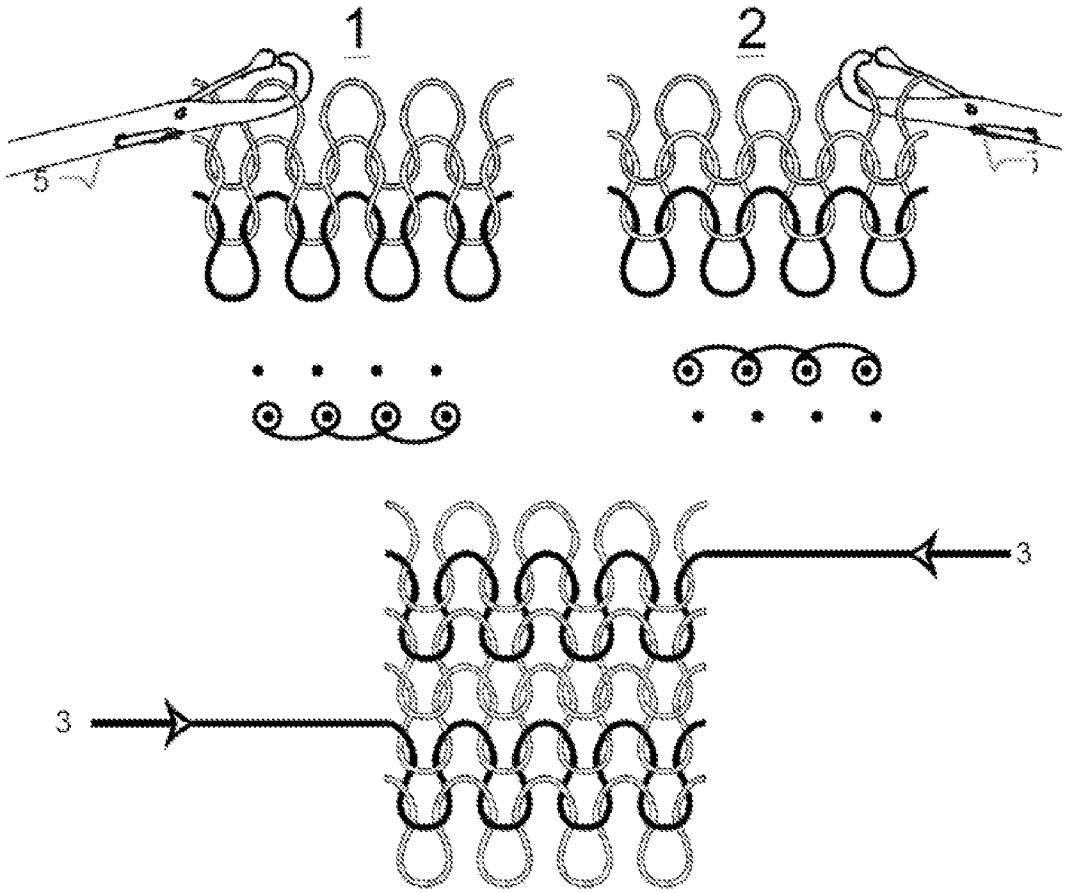
FIG. 1 illustrates the interplay between the needles and strands in forming a fabric in weft knitting.
Figure 2:
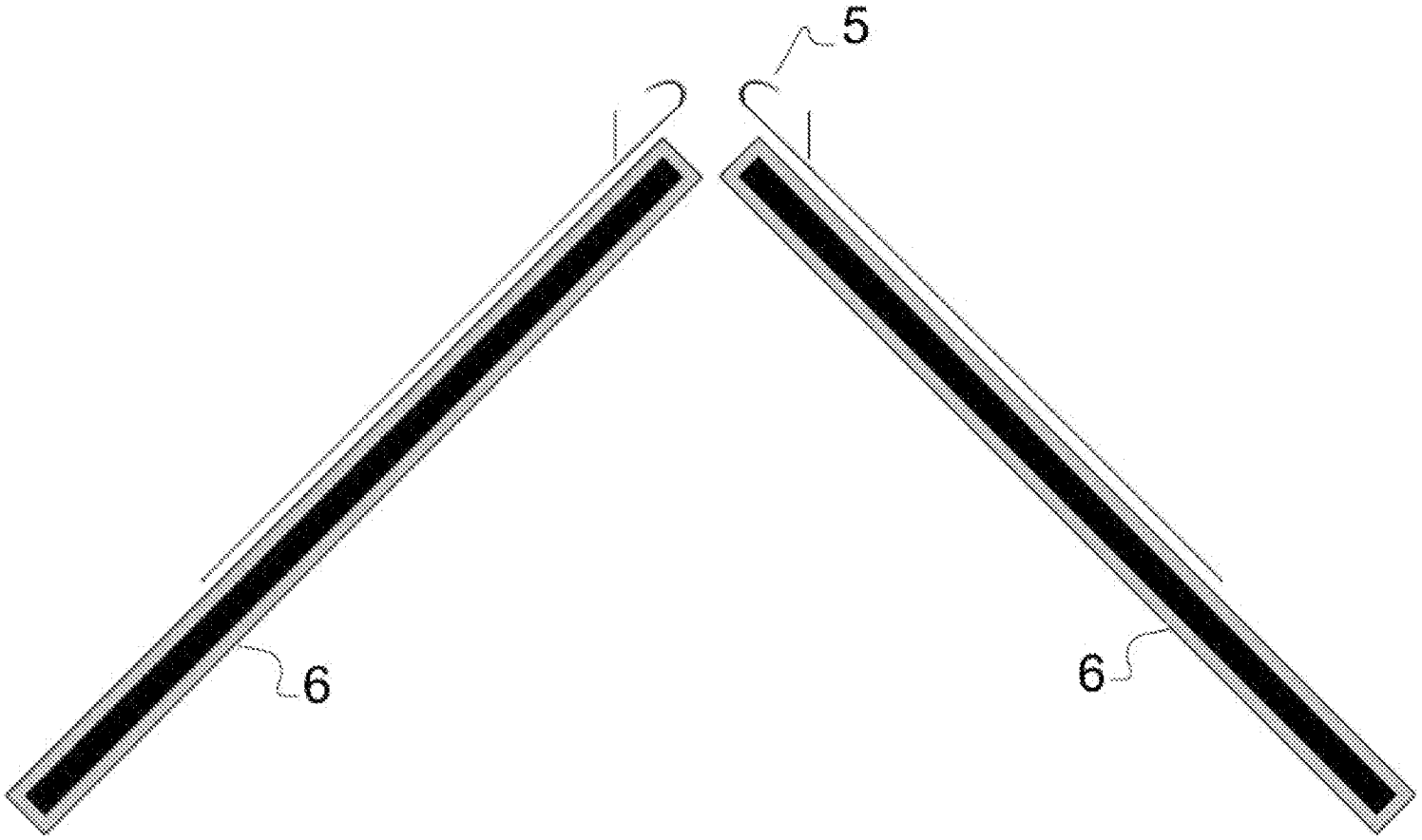
FIG. 2 illustrates a side view of a two-needle bed weft knitting machine.
Figure 3:
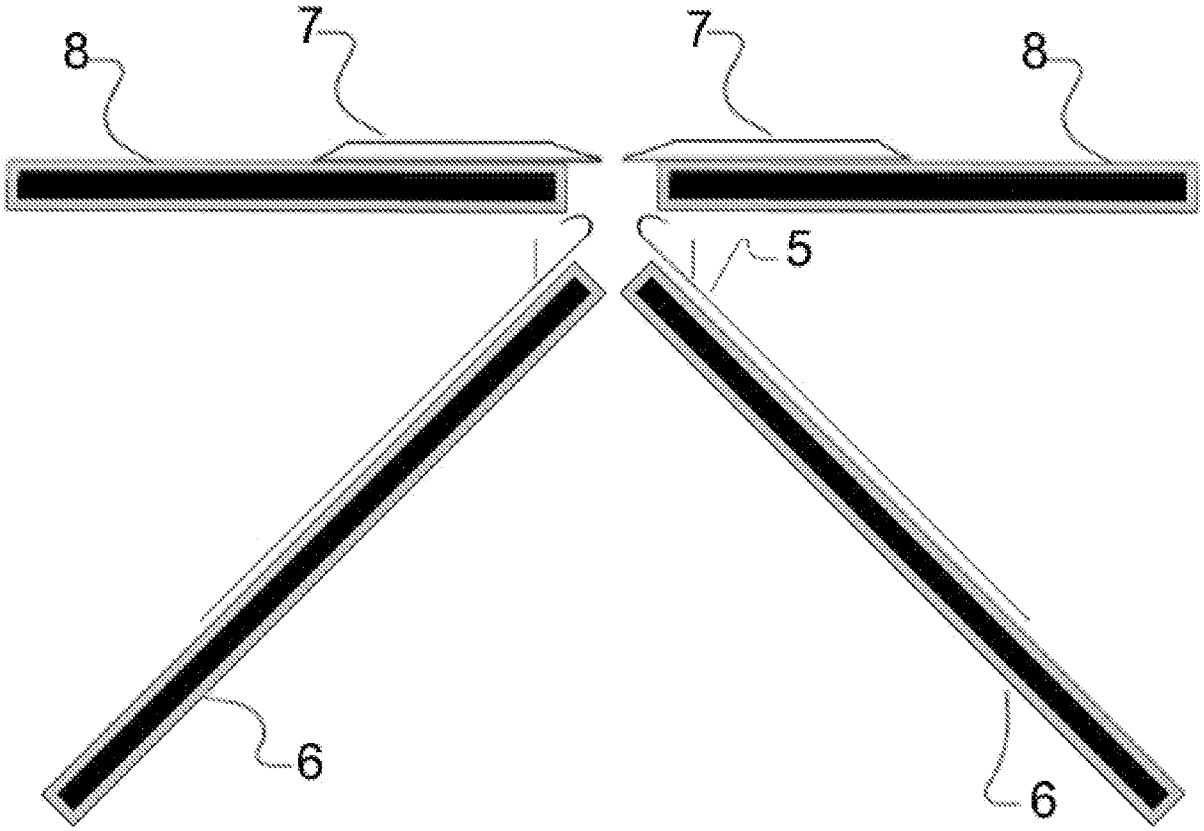
FIG. 3 illustrates a side view of a four-needle bed weft knitting machine.
Figure 4:
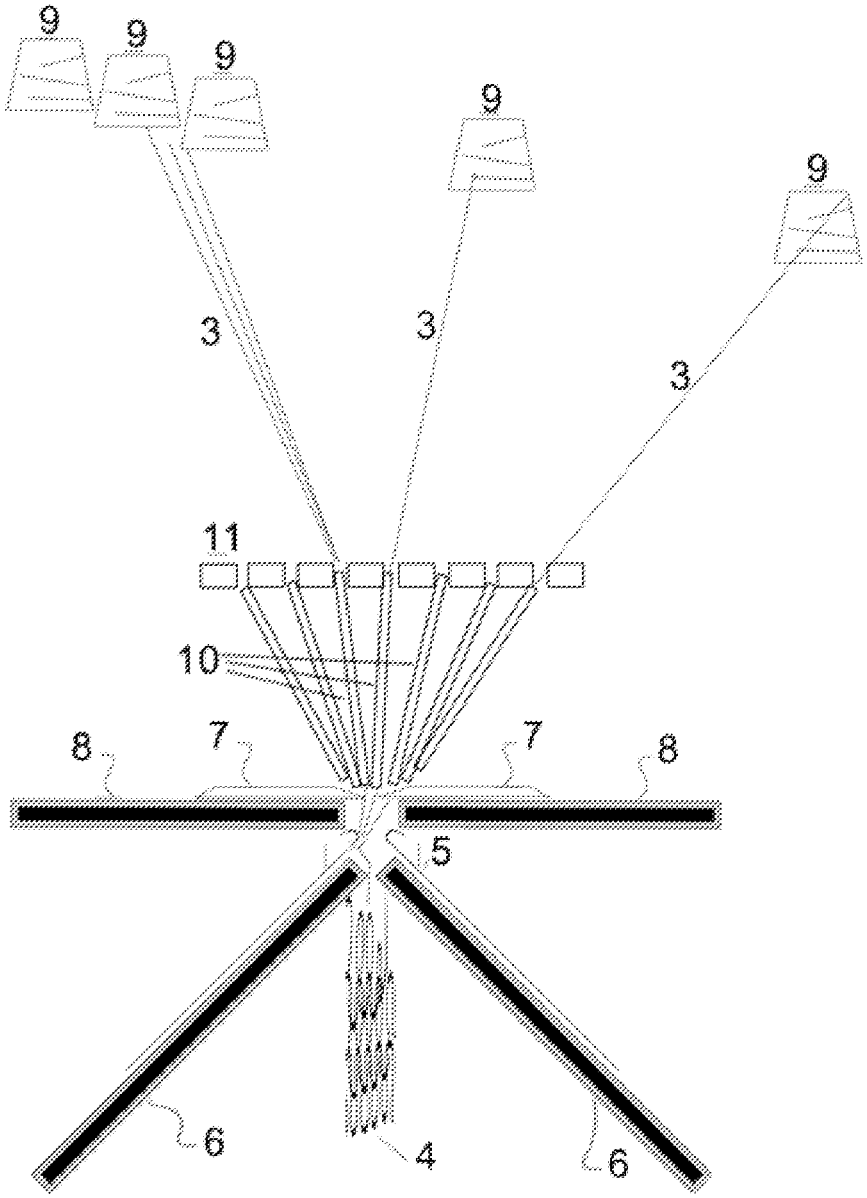
FIG. 4 illustrates a side view of a four-needle bed weft knitting machine with a fabric exiting the machine.

Embodiments of the present disclosure provide a mechanism of knitting a warp insertion reinforcement structure while knitting a weft knitting textiles or textile components.

Embodiments of the present disclosure incorporate a warp structure on a weft knitted fabric as a unitary construction by using a V-bed flat knitting machine for example. The unitary construction comprises one or more yarn materials, which are incorporated into one or more weft and warp stitch structures. Each stitch structure may have a specific set of mechanical properties derived from the properties of the selected materials, such as the tension exerted by various knitting machine parts on the material, and how the materials interlace and interloop with each other in a variety of directions. There may be one or more stitch structures in the fabric. In some embodiments, two or more layers, layer portions, components, appendages, and/or ply portions may combine to form a unitary construction. The properties of each warp structure, combined with how it is introduced into the fabric as a structure and how warp structures and fabric structures are combined, can substantially contribute to the performance and comfort of the resultant fabric.

In some embodiments, each warp structure is integrated as part of a unitary construction. One or more warp structures can be integrated and completely formed and constructed by the machinery. Each warp strand is completely manipulated into a fabric structure, including any additional layer, layer portion, components, appendage, and/or ply, entirely by the machine. Each layer, layer portion, component, appendage, and/or ply is also configured by the knitting machine in the same knitting process. A base fabric may include one or more knitted structure layers, layer portions, components, appendages, and/or ply portions exhibiting different features. One or more knitted layers, layer portions, components, appendages, and/or ply structured components may be of the same or different knitted constructions and/or geometric configurations, each having a technical face side 1 and a technical reverse side 2 that can have different knit configurations. One or more knitted layers, layer portions, components, appendages, and/or ply portions structured components may also incorporate portions of a single layer construction and portions of a double layer construction, and/or pockets, channels, welt tunnels, gores, voids, ventilation holes, and other structural and functional knitted constructions, which may be integrated in one or more areas of the knitted construction. Inserts, hardware, foam, wiring, fiber optics, printed circuit boards, computing chips, heating elements and other materials may be placed into the pockets, channels, welt tunnels, gores, voids, and other structural and functional knitted constructions to provide support, stability, cooling or heating, e-textile and/or smart performance characteristics and/or other desired properties to the knitted component layers and/or layer portions and/or appendage structures. Warp structures may be integrated to intersect, connect to, frame, and otherwise interact with the integrated structures and/or inserts in the main body and or any component structure or layer.

Performance strand materials may be anatomically, mathematically and proportionally arranged in a warp structure. One or more warp structures may be mathematically and proportionally arranged in one or more fabric structures to deliver specific desired performance characteristics. Performance strands may be incorporated as one or more warp structures, where one or more strands or groups of strands are inserted into a base fabric structure. Impact-easing strands such as auxetic materials, silicon, Dupont Hytrel and/or other elastic materials may also be integrated into a base fabric structure to ease impact of motion in running, jumping, bursting, or sliding.

In some embodiments, a V-bed knitting process creates multiple three-dimensional structures in the same panel structure and utilizes various materials strategically mathematically and proportionally. The various materials are placed in the warp and weft for specific characteristics to improve a manufacturing process and/or function of the resultant product. These materials may include a material adding strength to specific areas, a temporary supporting but sacrificial material that disappears in the manufacturing process, an elasticated material that creates flex joins or live hinges in the knit structure, a material that expands with the addition of heat and/or steam to support structures, a shape memory material, a vibration dampening material for examples ceramics in the case of composite structures or auxetic yarns in soft goods, a material that creates clean edges around voids or creates cavities of reinforced shape, dimension, and positioning in a resultant fabric structure, a material for housing inserted components, a material strategically placed to shield RF or electronic cables and/or thermal coupling wires that permanently situate connection spots in the resultant fabric ready for a post process. For example, the post process involves attaching the knitted material too hardware components such as electronics, solar elements, power sources, GPS, RFIDs, cameras, controls, speakers, screens, monitors, or other devices.

According to embodiments of the present disclosure, a knitting process may use the knitting machine to incorporate one or more pocket structures into one or more layers, layer portions, components, and/or plies. A component can be inserted in a post process or between the needle beds of the knitting machine and into the pocket during the knitting process, manually or robotically. The knitting machine then continues and seals the component into the knit structure. The component may be any type of functional component, for example an electronic component, an RFID sensor, a ballistic plate, a foam component, computer chip, a printed circuit board, a battery, or other component. The pocket may be completely closed without an opening, void, flap, or other structure that would allow unintended access to the embedded component.

A resultant fabric structure containing a warp element may be created as a multi-component unitary construction, wherein two or more component fabric structures are utilized. A warp structure may be integrated into a layer, layer portion, appendage, and/or ply. At least one other warp structure is integrated into at least one other layer, layer portion, appendage or ply. The two or more component layers, layer portions, appendages and/or plies can be aligned to form a resultant fabric structure with desired function and/or aesthetics.

Embodiments of the present disclosure enable formation of two and/or three dimensionally knitted fabric structures with one or more warp structures by utilizing lightweight plies of multiple layer and/or layer portions and/or appendage structures, functional materials, and functional structures, which are all completed in the knitting machine in an automated fashion. As a result, the knitted fabric structures are then ready for the following shoe making processes.

In some embodiments, two or more layers, layer portions, components, appendages, and/or ply portions may combine functions to form a unitary construction.

Embodiments of the present disclosure further provide a device on a weft knitting machine capable of introducing a warp element. The warp element may knit, tuck, inlay, and/or float as it is integrated into a base fabric structure in a knitting machine. Thus, it is technically a weft knit warp element. The weft knit warp structure element may travel horizontally, vertically, diagonally or in any combination of directions in a fabric on one face of a fabric, may travel in any combination of surfaces (both faces) of a fabric structure and/or internally inside a fabric structure, such as a spacer. It does not require permanent modification of a V-bed machine.

Weft knit warp elements are allowed to travel from one end of the machine's fabric to the other horizontally, diagonally, and in any combination of directions. The machine may have one or more strands in a weft knit warp structure, or one or more weft knit warp structures in a fabric. Two or more weft knit warp structures may travel in different directions in a fabric. Two or more weft knit warp structures may overlap each other one or more times in a fabric. Multiple specialized strands may be integrated in one or more weft knit warp structures in a fabric. The electronic weft machine can be configured to make sequential fabric structures with integrated weft knit warp structures of essentially the same configuration, or sequential fabric structures with integrated weft knit warp structures of differing configurations. The entire process may be performed by a V-bed weft knitting machine with no need for human operator intervention.

DETAILED DESCRIPTION

Reference will now be made in detail to the preferred embodiments of the present invention, examples of which are illustrated in the accompanying drawings. While the invention will be described in conjunction with the preferred embodiments, it will be understood that they are not intended to limit the invention to these embodiments. On the contrary, the invention is intended to cover alternatives, modifications and equivalents, which may be included within the spirit and scope of the invention as defined by the appended claims. Furthermore, in the following detailed description of embodiments of the present invention, numerous specific details are set forth in order to provide a thorough understanding of the present invention. However, it will be recognized by one of ordinary skill in the art that the present invention may be practiced without these specific details. In other instances, well-known methods, procedures, components, and circuits have not been described in detail so as not to unnecessarily obscure aspects of the embodiments of the present invention. The drawings showing embodiments of the invention are semi-diagrammatic and not to scale and, particularly, some of the dimensions are for the clarity of presentation and are shown exaggerated in the drawing Figures. Similarly, although the views in the drawings for the ease of description generally show similar orientations, this depiction in the Figures is arbitrary for the most part. Generally, the invention can be operated in any orientation.

In some embodiments, a weft knitting machine capable of creating a warp structure includes a means for automatically controlling the rate of yarn deployment and so the speed at which a material is withdrawn from the packages for feeding though the warp.

An exemplary warp feeding system disclosed includes three subsystems. One is a stop motion and yarn alignment subsystem, which may include a shelf mount supporting both a battery of electronic stop motions (e.g., in a narrow configuration) and a strand guide in the unspooling area for holding the bobbins to feed the warp system. The second subsystem is the knitting assembly, which includes replacement of the clearing cam in the knitting cam box with a specially designed cam. The third subsystem is a yarn feeder which includes modification to the OEM standard knitting feeder. The examples described in detail herein refer to the modification of a Stoll CMS ADF flat knitting machine; however, the present disclosure is not limited thereto.

Figure 11:
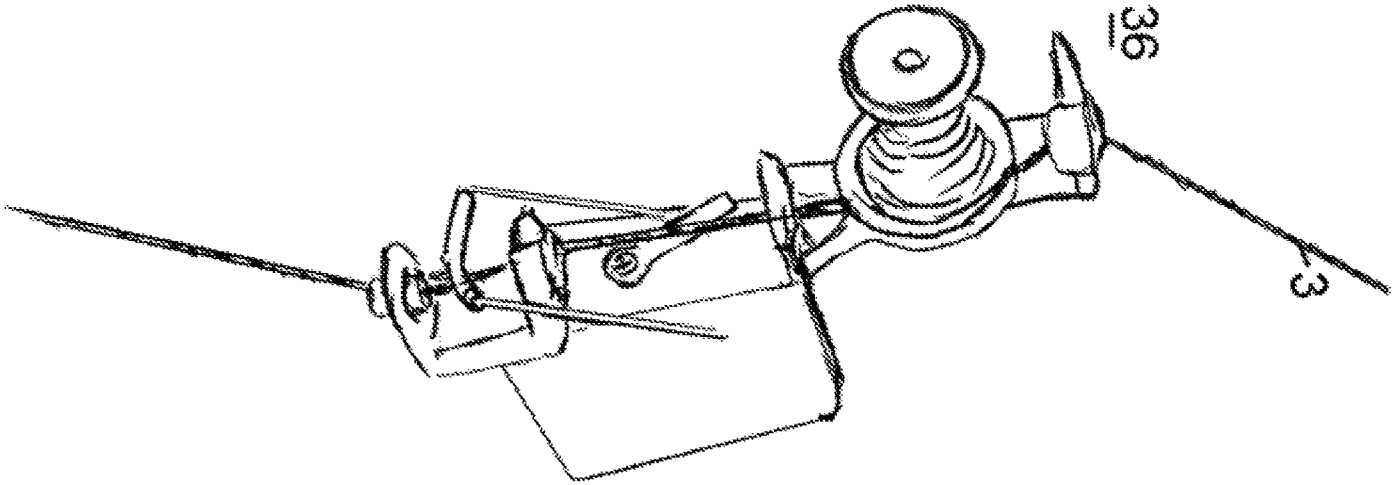
FIG. 11 shows an exemplary single electronic circular machine stop motion in accordance with an embodiment of the present disclosure.
Figure 12:
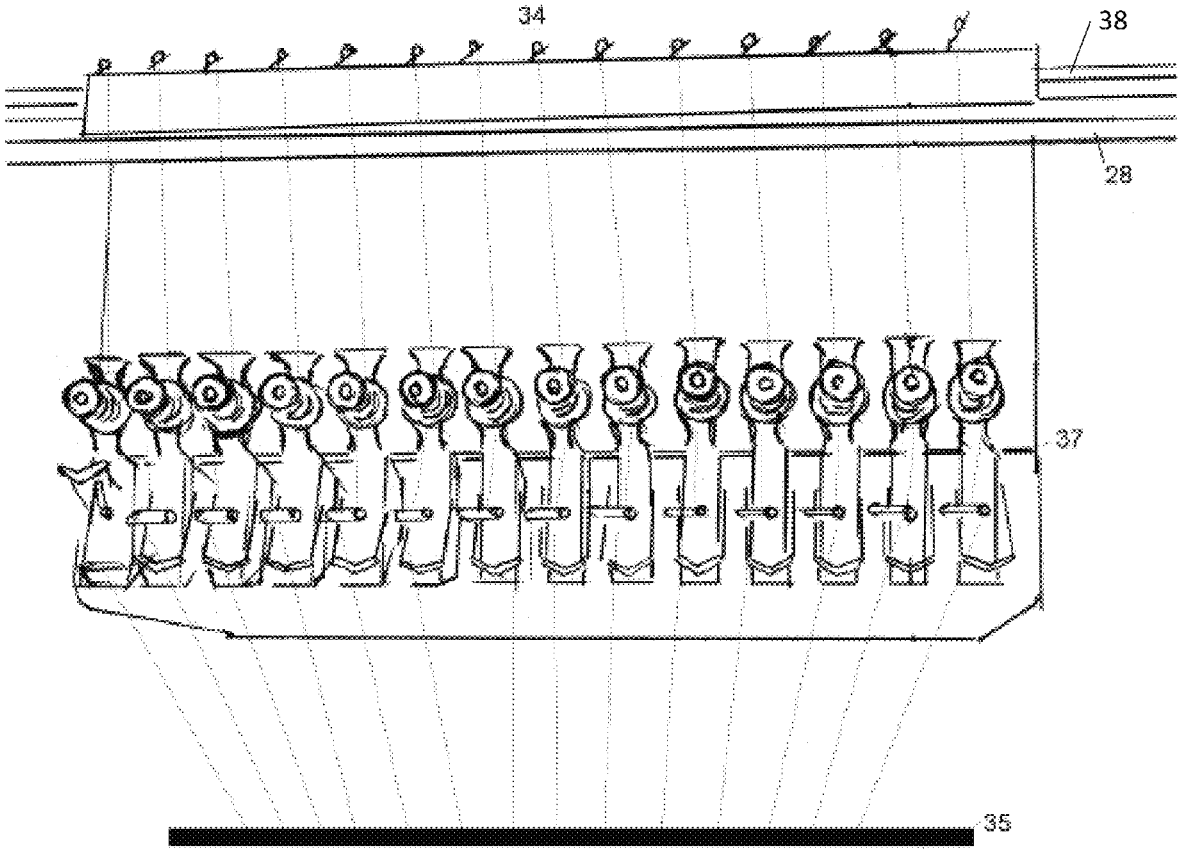
FIG. 12 shows a front view of an exemplary shelf mount weft knit warp yarn feed assembly in accordance with an embodiment of the present disclosure.

FIG. 11 shows an exemplary single electronic circular machine stop motion in accordance with an embodiment of the present disclosure. Utilizing standard stop motions for circular knitting machinery allows mounting a greater number of circular machine stop motions 36 in a narrow space typically available for the weft knit warp assembly 34 yarn feed system. FIG. 12 shows a front view of an exemplary shelf mount weft knit warp yarn feed assembly in accordance with an embodiment of the present disclosure.

Figure 9:
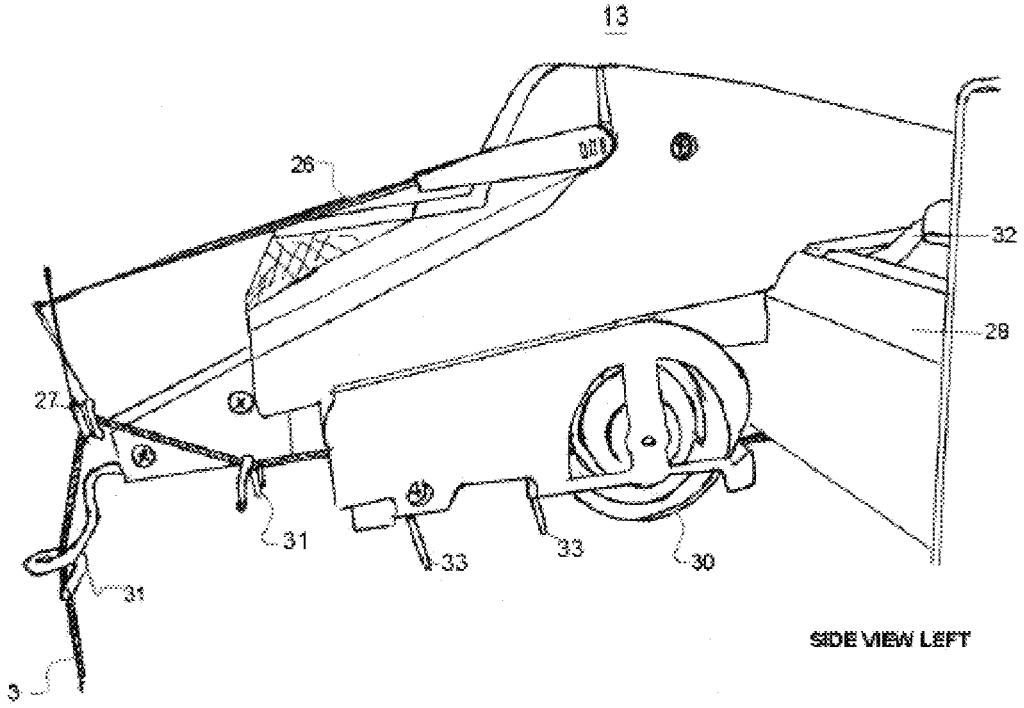
FIG. 9 (PRIOR ART)
FIG. 9 shows a left view of the OEM stop motion.
Figure 10:
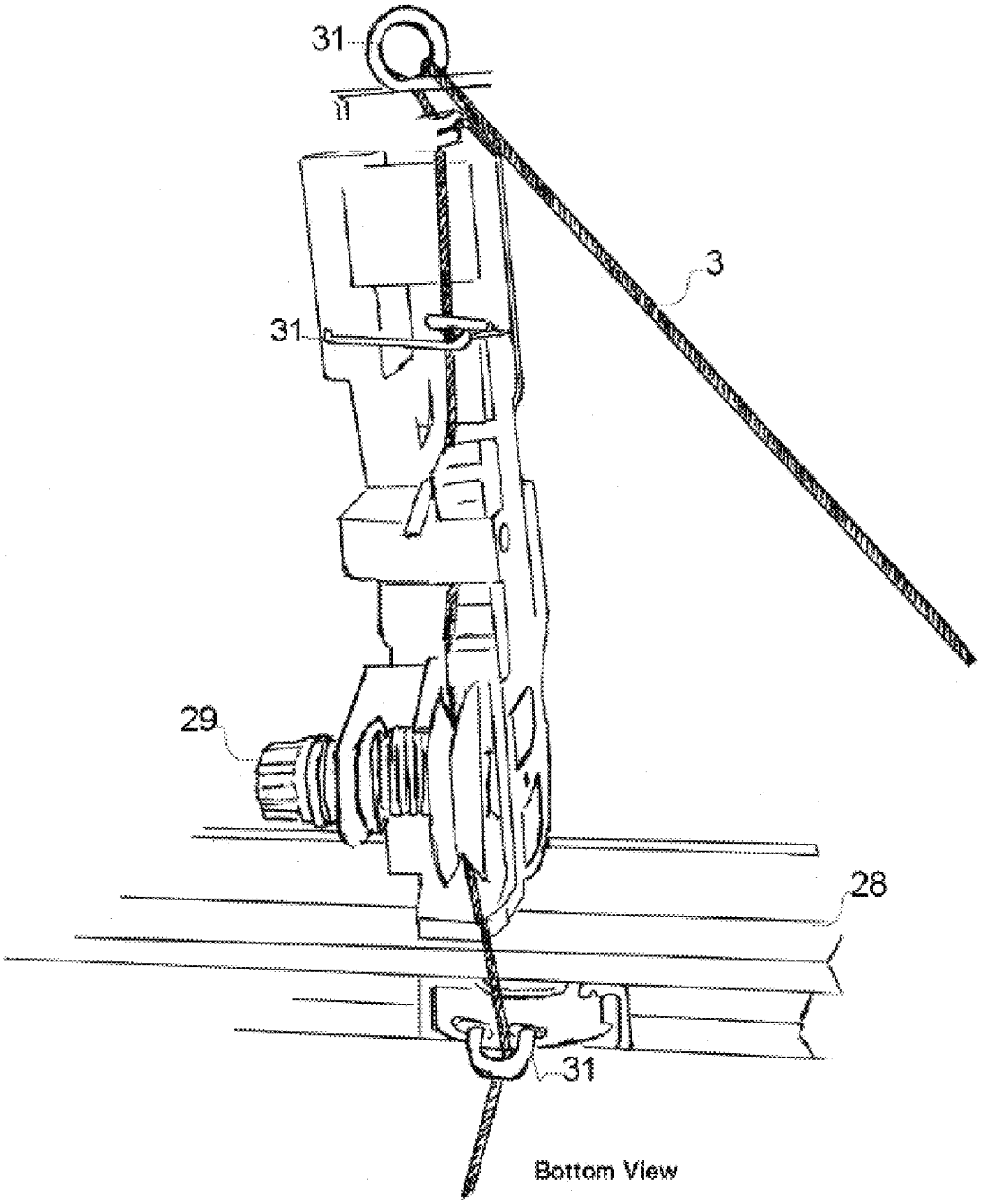
FIG. 10 (PRIOR ART)
FIG. 10 shows a bottom view of the OEM stop motion.
Figure 13:
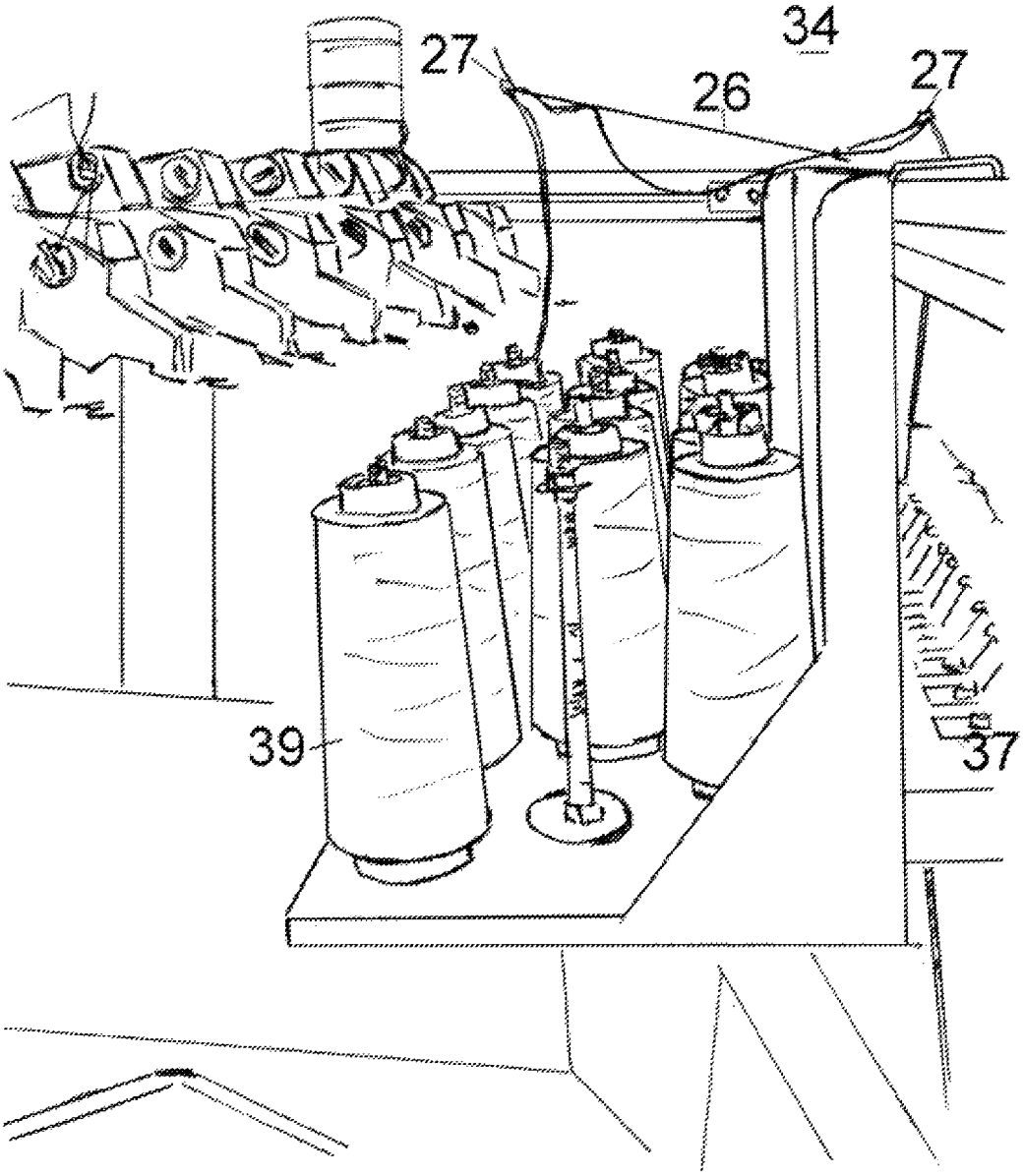
FIG. 13 shows a side view of the shelf mount weft knit warp yarn feed assembly in FIG. 12.

FIG. 13 shows a side view of the shelf mount weft knit warp yarn feed assembly in FIG. 12. In FIG. 12, fourteen such circular machine stop motions are mounted on an added electronic extension bar assembly 37 which is configured to align the strands to a warp strand alignment bar 35. The electronic extension bar assembly 37 connects to the machine's existing OEM stop motion system via the OEM cable 32 in the OEM rail bar 28 as described in FIG. 9.

The shelf mounted weft knit warp assembly 34 is suspended from an additional support bar 38 that is mounted over the front of the knitting machine, in front of the standard OEM stop motion rail 28. The shelf mounted weft knit warp assembly supports both the stop motions on the front (FIG. 12) and on the rear of the shelf (FIG. 13) and has up to fifteen treaded posts to hold bobbins 39 of yarn and/or strands of material. The material on a bobbin is pulled by the action of the knitting machine. The shelf mounted weft knit warp assembly has a spring arm 26 with a pot eye 27 to guide each strand from a bobbin or an unspooling device 42, through the front of the shelf mount assembly's electronic extension bar assembly 37 through the warp yarn alignment bar 35 to one or more feeders of the knitting machine.

Figure 5:
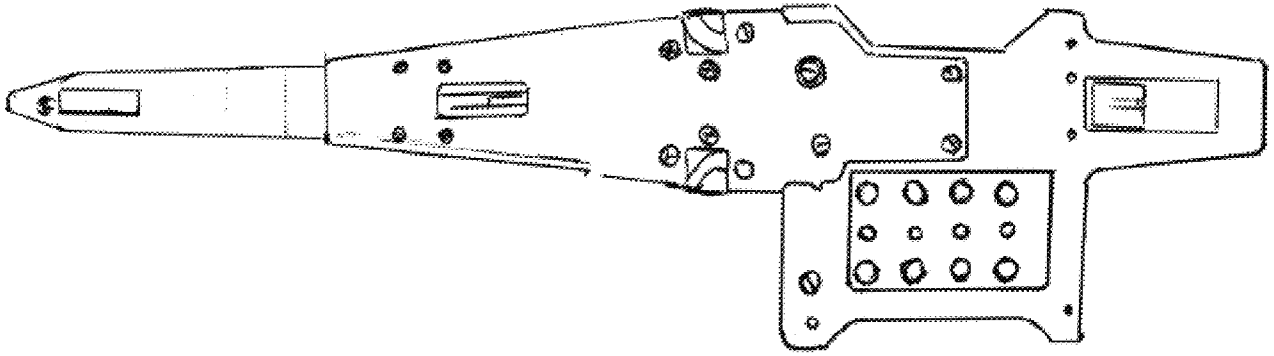
FIG. 5 (PRIOR ART)
FIG. 5 shows an autarkic feeder.
Figure 6:
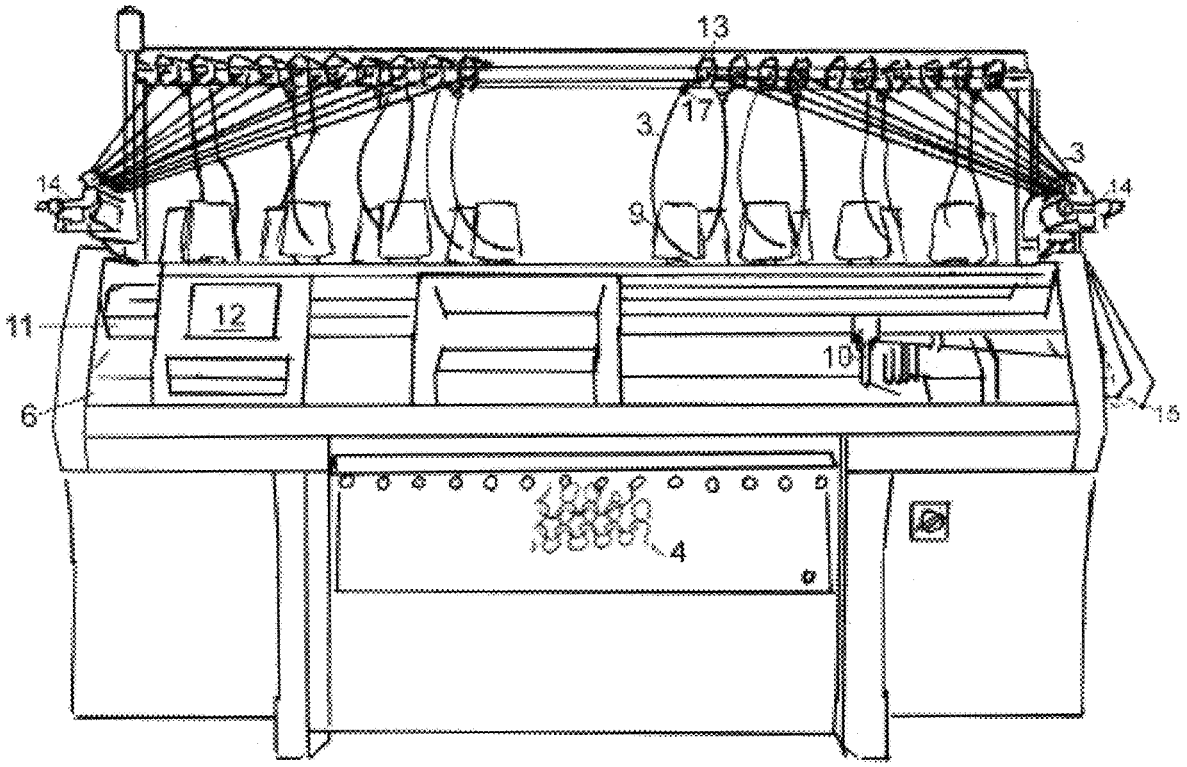
FIG. 6 shows a front view of a V-bed knitting machine.
Figure 7:
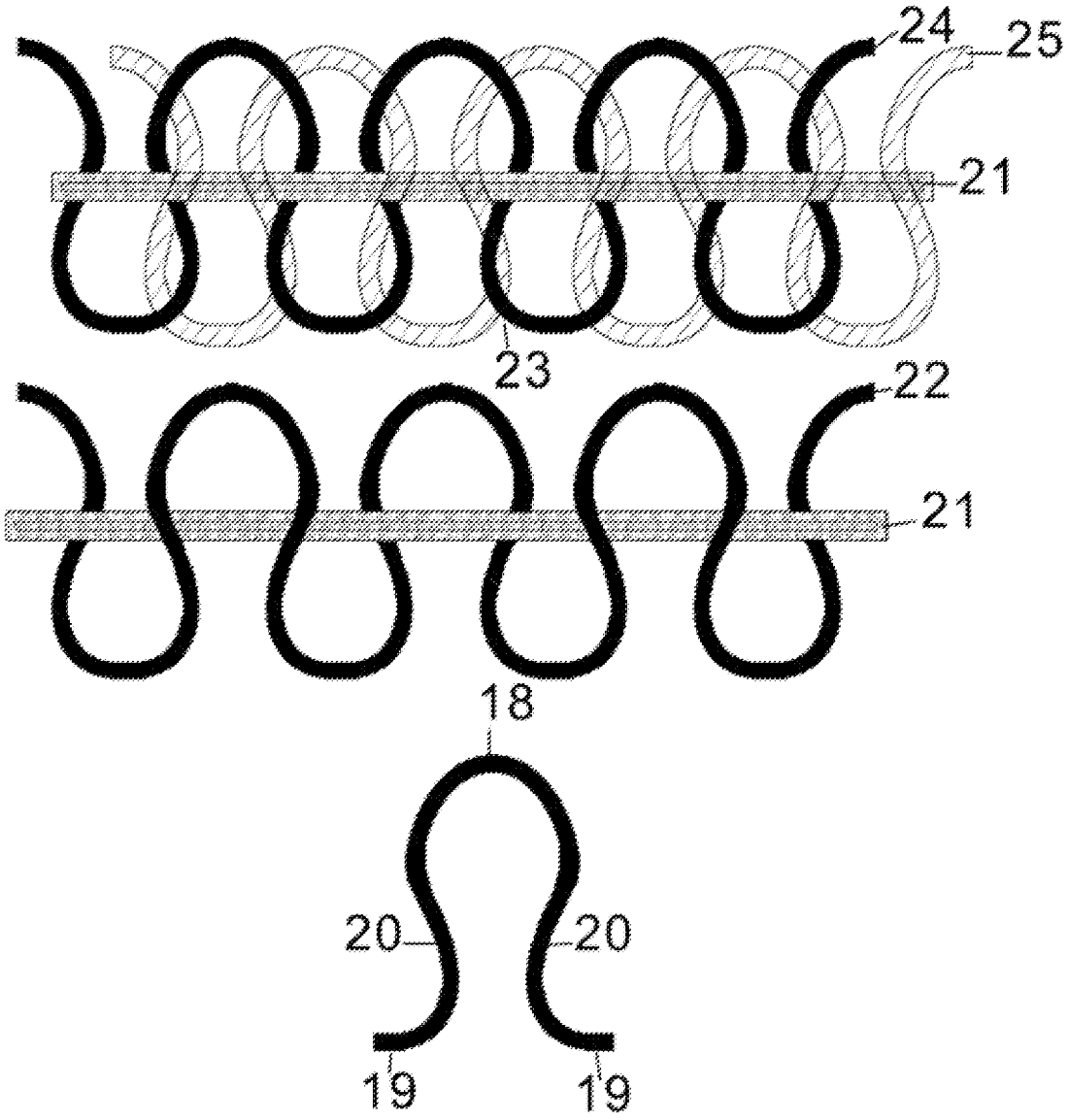
FIG. 7 shows parts of a knitted loop or a stitch.
Figure 8:
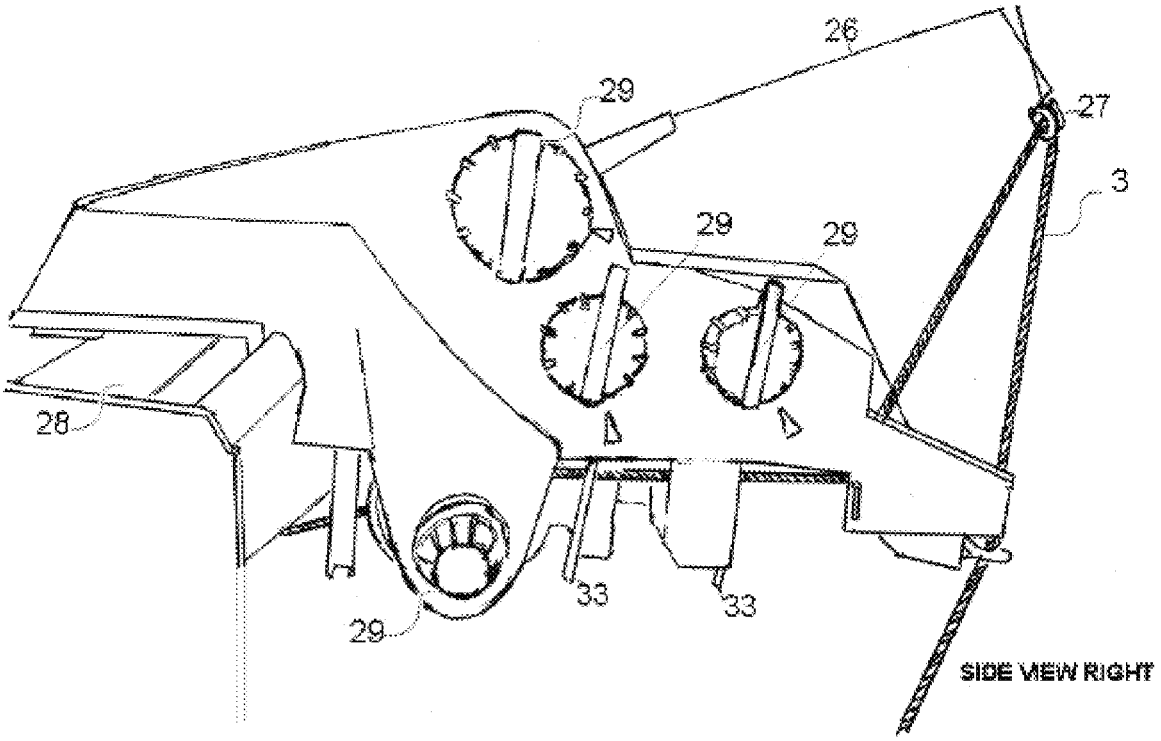
FIG. 8 (PRIOR ART)
FIG. 8 shows a left view of an OEM stop motion according to the conventional art.
Figure 14:
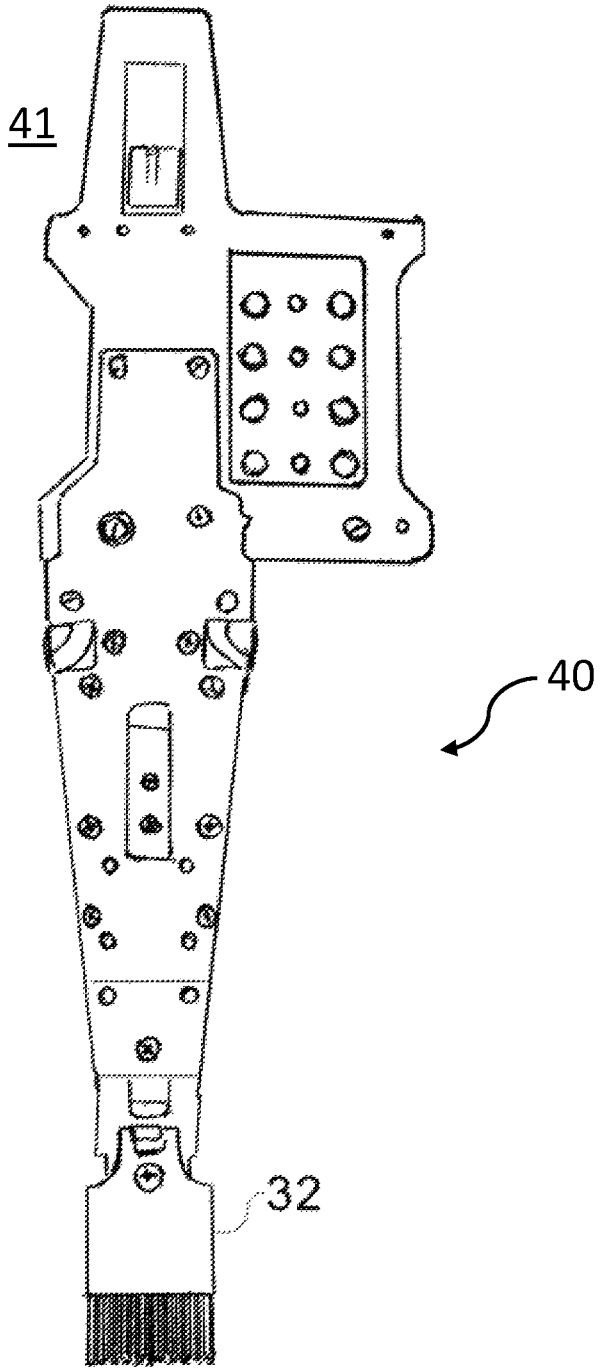
FIG. 14 shows an exemplary weft knit warp feeder in accordance with an embodiment of the present disclosure.

FIG. 14 shows an exemplary weft knit warp feeder in accordance with an embodiment of the present disclosure. In some embodiments, compared to a conventional stock machine feeder (or "unmodified feeder" herein) as shown in FIG. 5, an exemplary stock machine feeder (or "a modified feeder" herein) according to this disclosure features removal of the existing stock feeder tip and the addition of a standard warp knitting loom or crochet machine guide needle block 32 or other such additional part that is capable of holding warp strands to interface with the knitting needles and needle beds of a weft knitting machine. An additional strand guide bar 35 is added to the machine to gather and guide the strands into each standard yarn carrier feeder and/or standard yarn feeder modified with a modified a warp guide block ("weft knit warp feeder") or other such additional part that is capable of holding warp strands to interface with the knitting needles and needle beds of a weft knitting machine. Both the modified (e.g., shown in FIG. 14) and unmodified feeder types (e.g., shown in FIG. 5) may run in a fabric on a warp knit weft modified machine.

Figure 15:
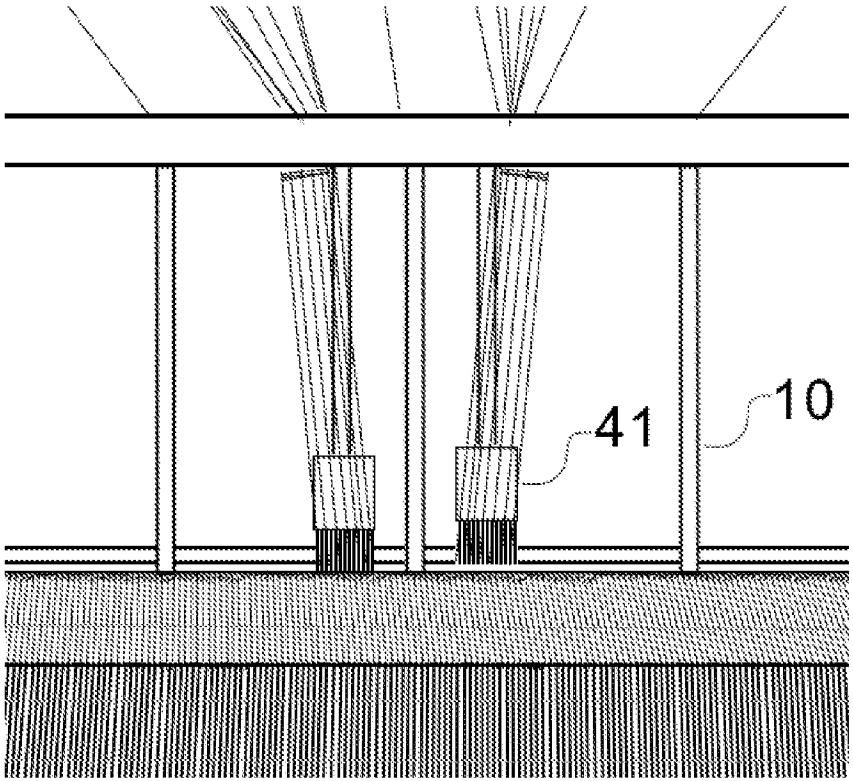
FIG. 15 shows the space of the feeder's space of an exemplary weft knit warp feeder in accordance with an embodiment of the present disclosure and the conventional OEM feeder.

Each attached weft knit warp feeder mechanism 40 may hold one or a plurality of strands in the same thickness profile space as the unmodified stock yarn carrier feeder tip. FIG. 15 shows the space of the feeder's space of an exemplary weft knit warp feeder 41 in accordance with an embodiment of the present disclosure and the conventional OEM feeder 10.

Figure 16:
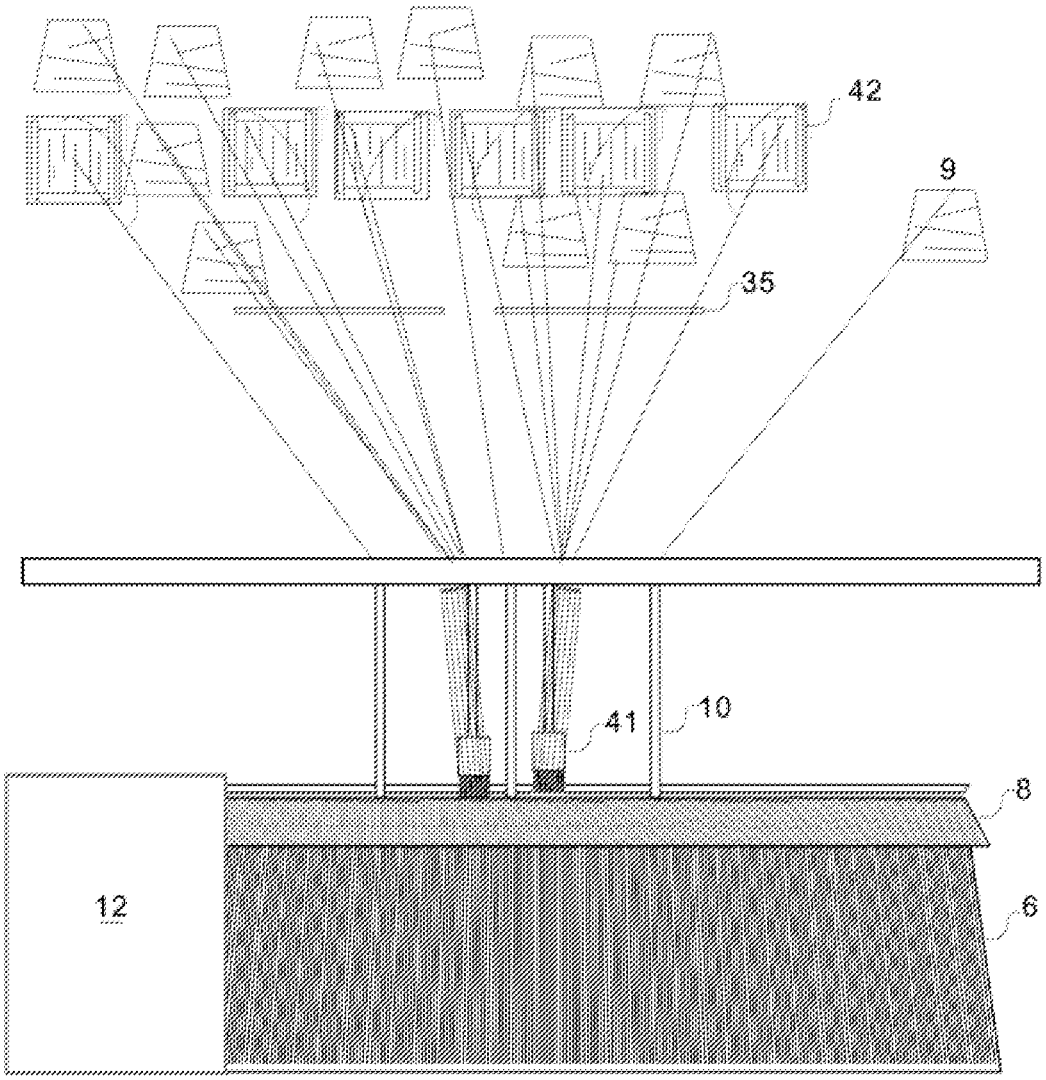
FIG. 16 shows a front view of an exemplary knitting machine with modified feeders in accordance with an embodiment of the present disclosure and unspooling devices and cones.

By using a stock machine software to control the motions of the standard machine feeder system (e.g., raising, lowering, and lateral actions), the "weft knit warp feeder" may introduce a plurality of strands to inlay, and move between the already made loops, in a designated and constant knitting system of the cam box 12. FIG. 16 shows a front view of an exemplary knitting machine with modified feeders in accordance with an embodiment of the present disclosure and unspooling devices and cones.

Figure 17:
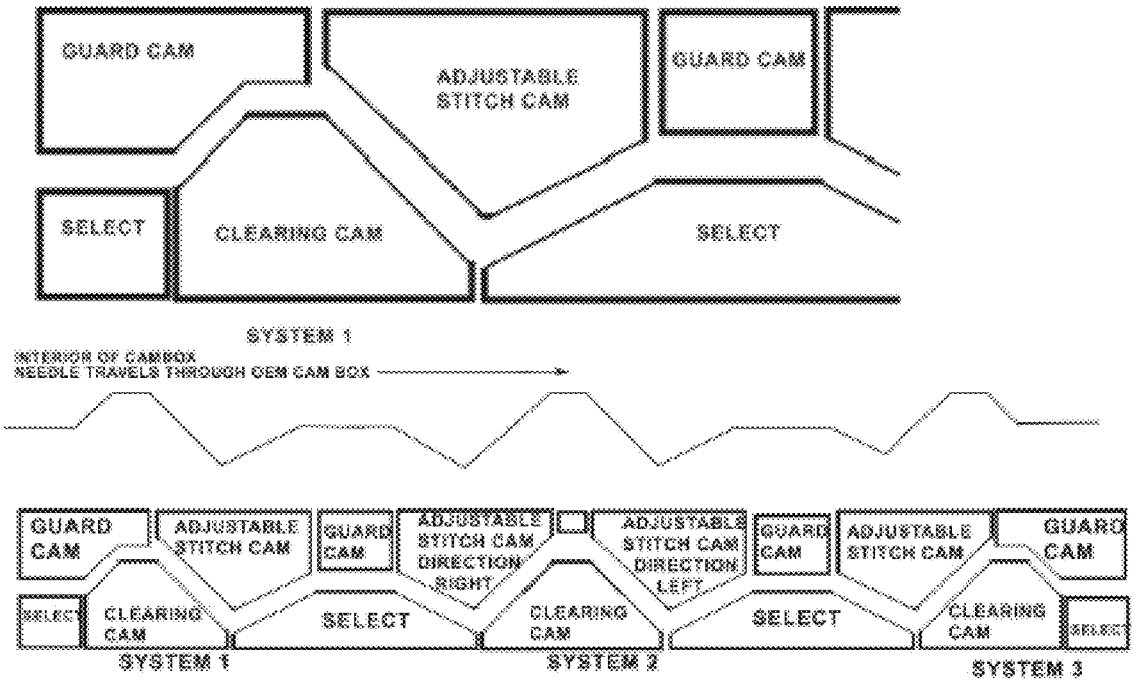
FIG. 17 (PRIOR ART)
FIG. 17 shows a needle traveling through a conventional cam box feeder.

FIG. 17 shows a needle traveling through a conventional cam box feeder. A selected needle travels through a cam box, for example a three-system cam box. The needle will have the option of being selected in one, two, three or none of the systems. A selected needle travels to knit or tuck in a selected system and then clears the loops. The needle is guarded from traveling too high or too low, and returns to be selected or not in the following system. The selection process repeats for system 2 and system 3.

Figure 18:
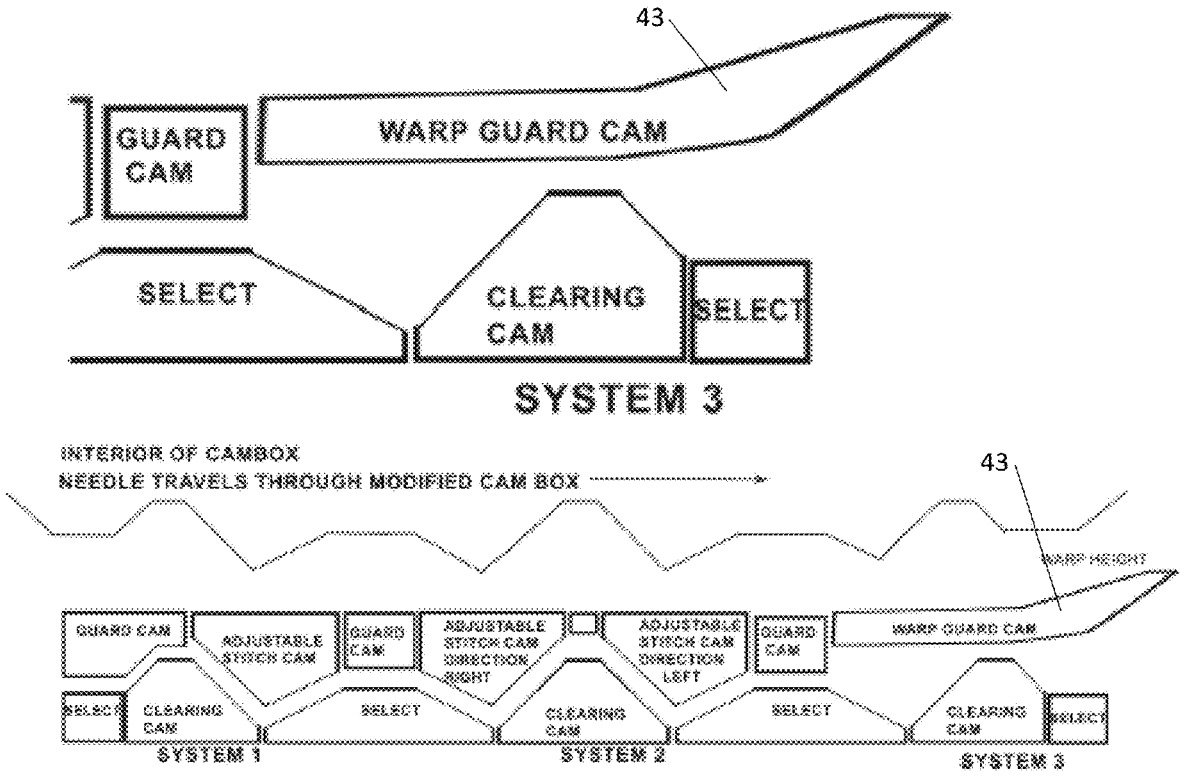
FIG. 18 shows a needle traveling through an exemplary modified weft knit warp cam box in accordance with an embodiment of the present disclosure.

FIG. 18 shows a needle traveling through an exemplary modified weft knit warp cam box in accordance with an embodiment of the present disclosure. In an exemplary weft knit warp system according to this disclosure, a user can select which end system will be designated for modification to a warp system in a three-system machine. FIG. 18 demonstrates the right-hand SYSTEM 3 is designated for the modified warp system. In that same designated system, one of the two stitch cams is removed; and the guard cams are replaced with the exemplary warp guard cams 43, which raise the needles to a warp height. In an exemplary knitting sequence, the cam box of the machine moves in the right-hand direction and knits in SYSTEM 2 and SYSTEM 3 of the three-system knitting machine by utilizing normal knitting. The machine cam box 12 then moves to the left, knits or tucks loops in one or more systems, and leaves a needle selection up in the third system by using the exemplary warp guard cams.

Figure 19:
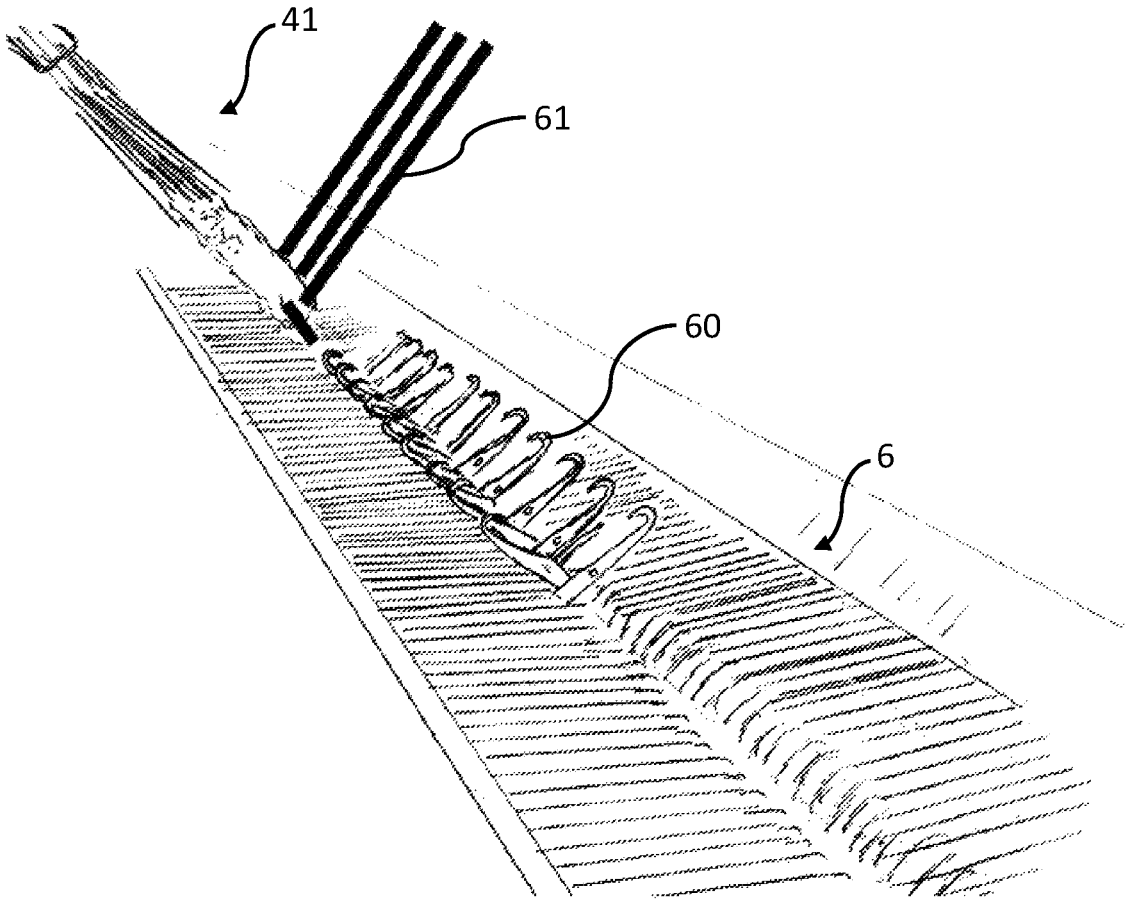
FIG. 19 shows an exemplary weft knit warp feeder in a rest position with selected needles raised to warp height in accordance with an embodiment of the present disclosure.
Figure 20:
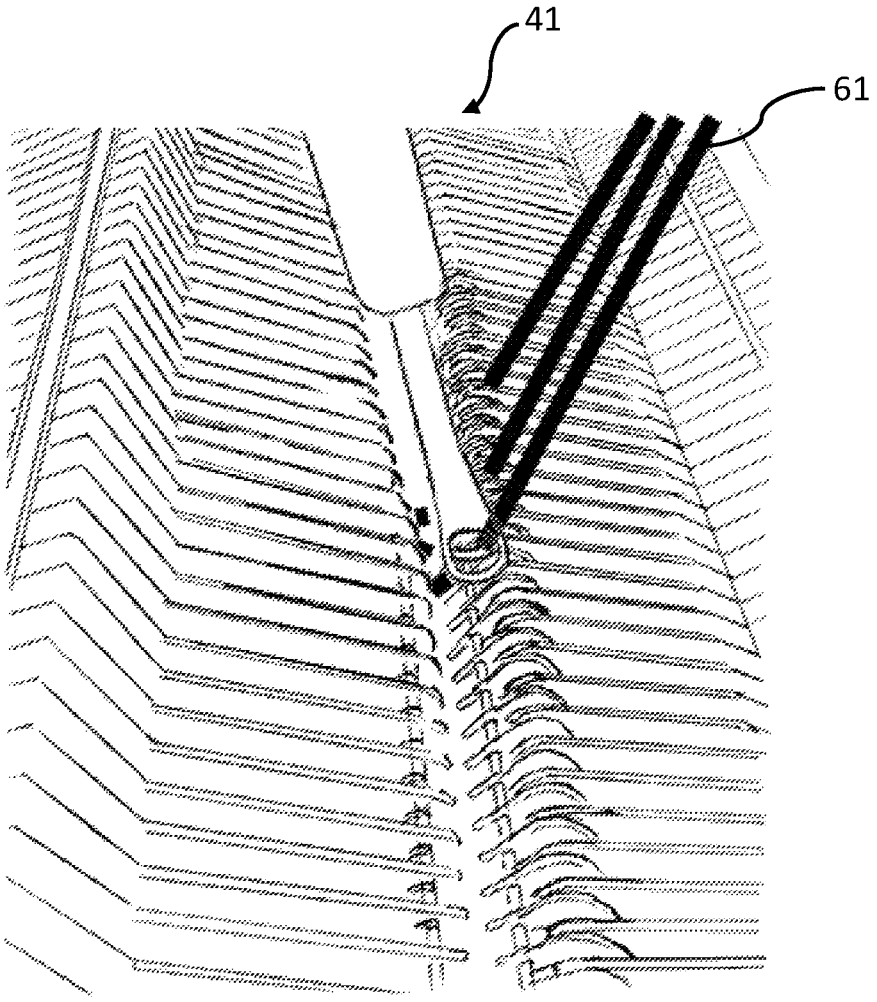
FIG. 20 shows an exemplary weft knit warp feeder feeding yarn in accordance with an embodiment of the present disclosure.

FIG. 19 shows an exemplary weft knit warp feeder 41 in a rest position with selected needles 60 raised to warp height in accordance with an embodiment of the present disclosure. In this position, the hooks are above the needle bed 6, and no yarn feeding in this position. The machine cam box then pauses for a feeder action to move past the last needle selected in the warp structure. The feeder height of one or more of the weft knit warp feeders 41, containing one or a plurality of strands 61, is centered above the needles and lowered down to the knit height warp horizontal moving position. Then one or more of the weft knit warp feeders 41, containing one or a plurality of strands 61, are moved horizontally by predetermined needle steps (wherein the number of needles depends on the desired pattern). FIG. 20 shows an exemplary weft knit warp feeder 41 feeding yarn in accordance with an embodiment of the present disclosure.

Figure 21:
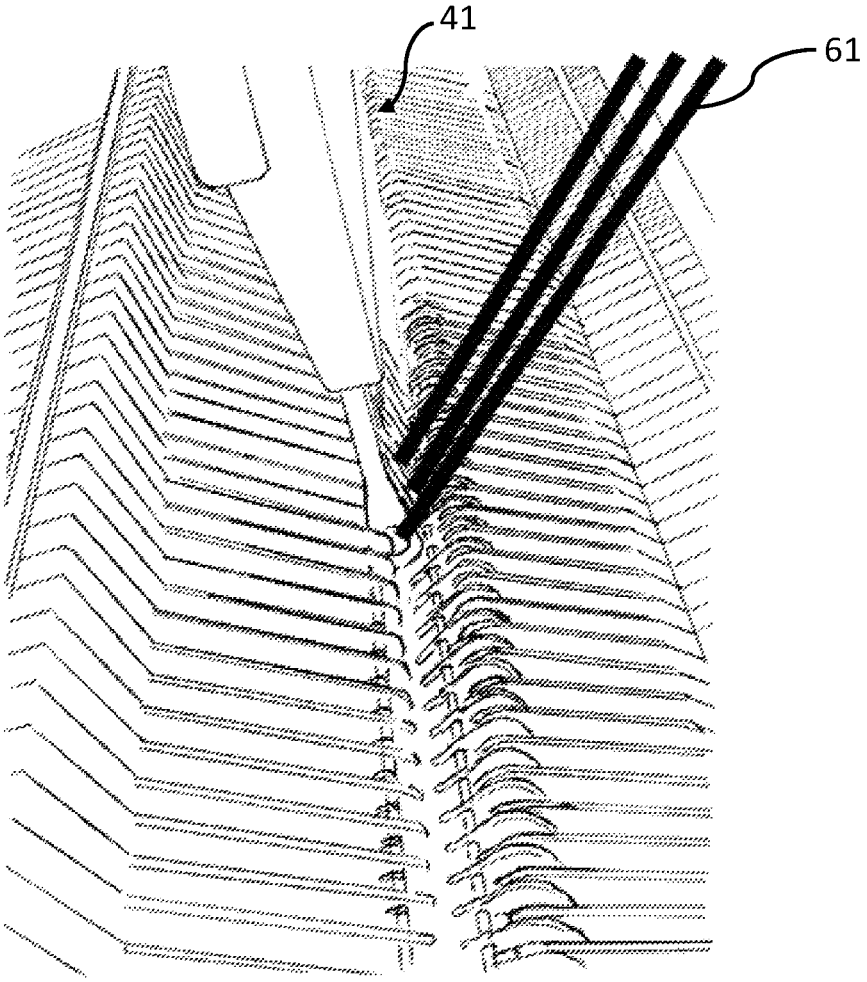
FIG. 21 shows the exemplary weft knit warp feeder in a swing position, laying yarn into hooks of needles, in accordance with an embodiment of the present disclosure.
Figure 22:
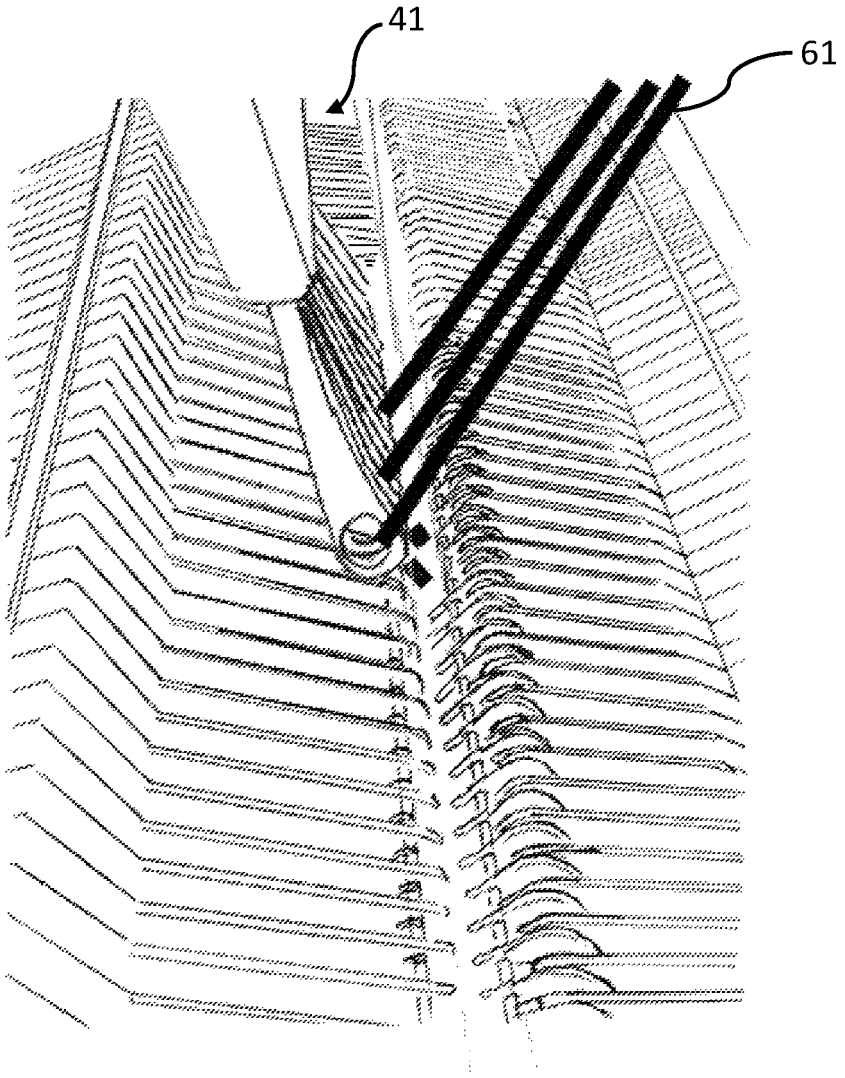
FIG. 22 shows the exemplary weft knit warp feeder moved to rest position in accordance with an embodiment of the present disclosure.

FIG. 21 shows the exemplary weft knit warp feeder 41 in a swing position, laying yarn into hooks of needles, in accordance with an embodiment of the present disclosure. One or all the weft knit warp feeders 41 containing the plurality of strands 61 stop and then lower to the warp swing position, positioning the strands 61 into the hooks of the needles. The machine then moves to the right and knits the selected warp needles with the cam box. The machine cam box pauses on slow speed for the next feeder action. One or more of the weft knit warp feeders 41 containing one or a plurality of strands 61 then return to the maximum up holding position. Any corrections for horizontal position are applied in accordance with configuration in the knitting program. The machine is then ready to knit as normal or to start the cycle again. FIG. 22 shows the exemplary weft knit warp feeder 41 moved to rest position in accordance with an embodiment of the present disclosure.

The strands inserted by weft knit warp feeders which contain one or a plurality of strands may act as a single strand/or a reinforcing group, adding additional strength, additional stretch, conductivity, or other specific performance characteristics to one or more zones of the knitted fabric construction. Polymer reinforcing fibers can be knitted as a weft knitted warp structure into a variety of fabric thicknesses and constructions to limit stretch in the weft or warp direction. Additional reinforcing materials or more complex double bed structures may be added multi-directionally to impart stronger areas of rigidity. Conversely, knitting on flat bed weft machines offers other features which are not possible in weaving or the conventional weft knitting.

Figure 23:
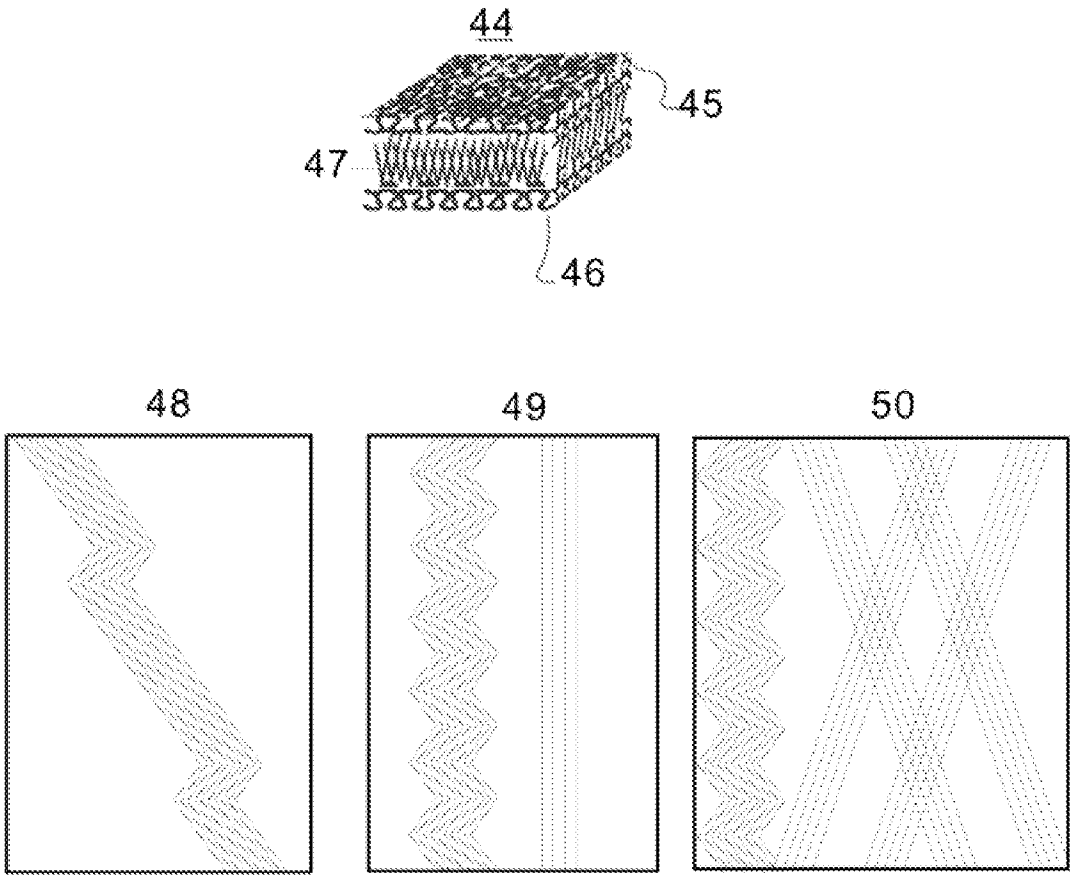
FIG. 23 shows an exemplary weft knit warp insert and a spacer structure 44 generated in an exemplary knitting process in accordance with an embodiment of the present disclosure.

FIG. 23 shows an exemplary weft knit warp insert and a spacer structure 44 generated in an exemplary knitting process in accordance with an embodiment of the present disclosure. The fabric structure, e.g., a spacer fabric, has a face fabric structure 45 and a rear fabric structure 46. The two structures are connected together by a series of tuck "Xs" or "Vs" of an internal material 47. The spacer 46 may have different properties on the face fabric from the rear fabric. The internal material 47 may have a different property entirely form the other two materials, or may be a combination of materials having a specific performance characteristic, when combined. One or more parts of the spacer may contain fields of intarsia, with each intarsia material having differing colors or properties. A weft knit warp structure may be integrated in, and/or on, one face of a fabric structure, on both faces, a combination of faces. Alternatively, it may be knitted internally in a fabric structure.

A fabric structure may itself have additional reinforcing structures. These may be in the form a weft knit warped material inserted vertically, horizontally, and diagonally into a fabric panel or a horizontal inlay. The weft knit warp may knit tuck or inlay in any combination of stitch structures. It may be asymmetrical 48 in a fabric panel. Two warp structures may travel in different patterns 49 and overlap in one or more areas 50 in a panel.

Figure 24:
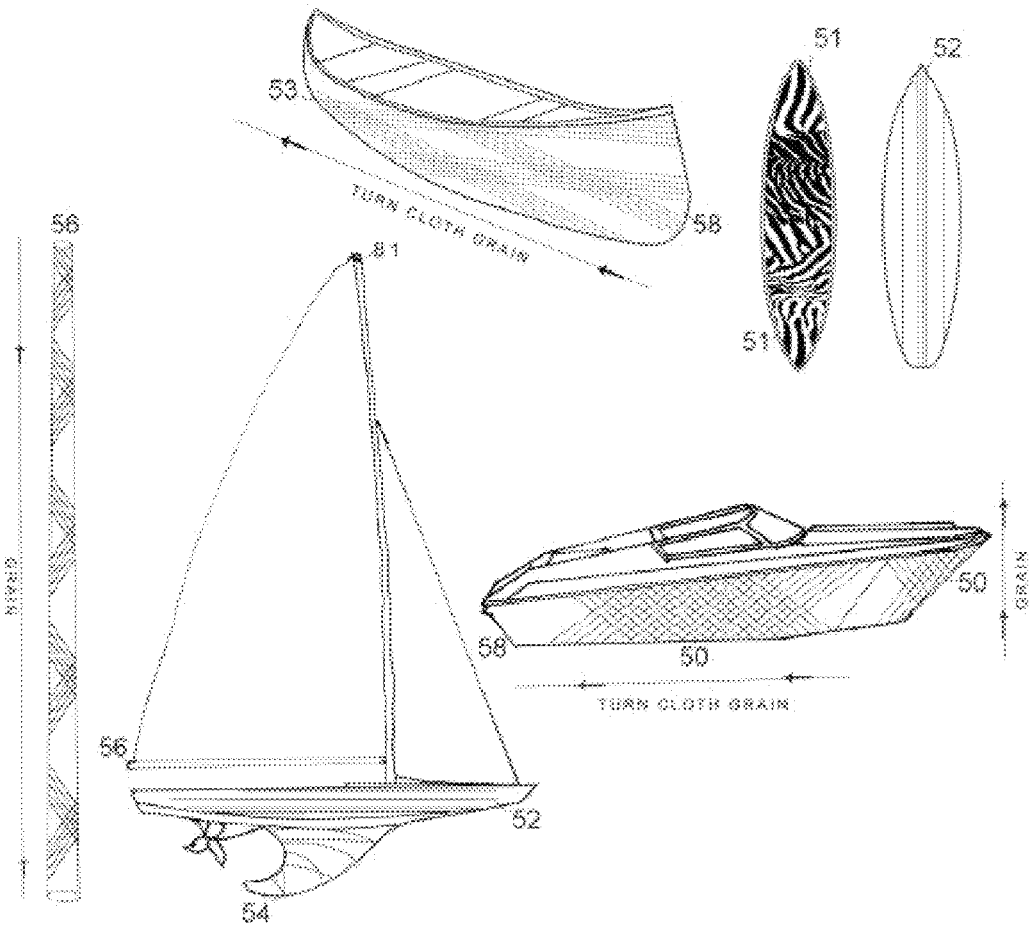
FIG. 24 shows fiber reinforced panels having weft knit warp structures in a marine application which can be produced in a knitting process in accordance with an embodiment of the present disclosure.

FIG. 24 shows fiber reinforced panels having weft knit warp structures in an exemplary marine application which can be produced in a knitting process in accordance with an embodiment of the present disclosure. The construction of a weft knit warp insert can be configured mathematically proportional to the panel dimensions and function. Warp structures may overlap each other (shown by overlapping reinforcing group of strands 50 in FIG. 24). A warp structure may lay on the surface of one side of a spacer. It may travel in the middle of the fabric unseen on either face. A warp structure may also travel from one face to another in any direction or combination of directions, dependent upon the desired aesthetic or performance characteristic of the polymer reinforcing structure. A warp knit weft strand/or group of strands may incorporate a function around a cylinder 56, a three dimension organic shape 54, reinforcing a three dimensional edge 51, a center panel structure 52, may be utilized as turn cloth 58, and/or as a single strand/or in groups of overlapping weft knit warp strands 53.

In some embodiments, a weft knit fabric integrating a warp insert has one or a plurality of stitch courses extending in a vertical direction and having a plurality of substantially parallel wales, wherein stitches in each course at each wale have a loop and an underlap. In some embodiments, at least one set of warp strands is held in the fabric by weft knitted stitches. Each warp strand may be laterally spaced in the fabric from each other warp strand in the fabric. During the knitting process, the warp strands may be guided in synchronicity to: form inlaid strands, form loops, or interlace with one with another and/or adjacent weft knitted loops.

In some embodiments, a first set of warp strands each may be respectively inserted in the main body fabric stitches. Adjacent warp strands may be spaced from one another in the horizontal direction by the main body stitches.

In some embodiments, each warp strand is laterally spaced along the width of the fabric from adjacent warp strands. A plurality of wrap strands may be disposed between weft strands and extending in the weft direction between adjacent stitch wales.

In some embodiments, a weft knit warp inserted fabric has a laid-in warp and a relatively open woven appearance. The fabric includes: a first section of spaced-apart laid-in warp strands; at least one second section of laid-in spaced-apart warp yarns; and a third section of laid-in spaced-apart warp strands. The warp yarns of the third section of warp strands may not be in registration with the warp yarns of the first section. The first, second and third sections are held together by weft knitted strands, and the warp yarns of the three sections have an interlaced woven-like appearance in or attached to the main body fabric. There may be an additional section of spaced-apart laid-in warp strands, where the strands of the additional section are not in registration with the warp strands of the first and third sections.

In some embodiments, one or more knitted layers, layer portions, appendage components, and/or plies may be embedded with elements of weft knit warp structure textile applications, utilizing one or more types of materials including the aforementioned restrictive ligaments, stretch and recovery ligaments, NiTinol, metal wire elements, conductive materials, energy transmitting materials, fiber optic materials, ceramics, silicon, and materials with other properties. The materials may be inlaid, tucked, and/or knitted; they may create one or more structures such as: tunnel, channel, or three-dimensional raised structure; they may form one or more embedded structures with a series of knit loops, tucking loops, missed loops, or transfers. The warp guide material may be guided horizontally, vertically, or diagonally, or any combination of directions on an X, Y, Z directional plane grid. The strands may provide an interactive element to a fabric.

Figure 25:
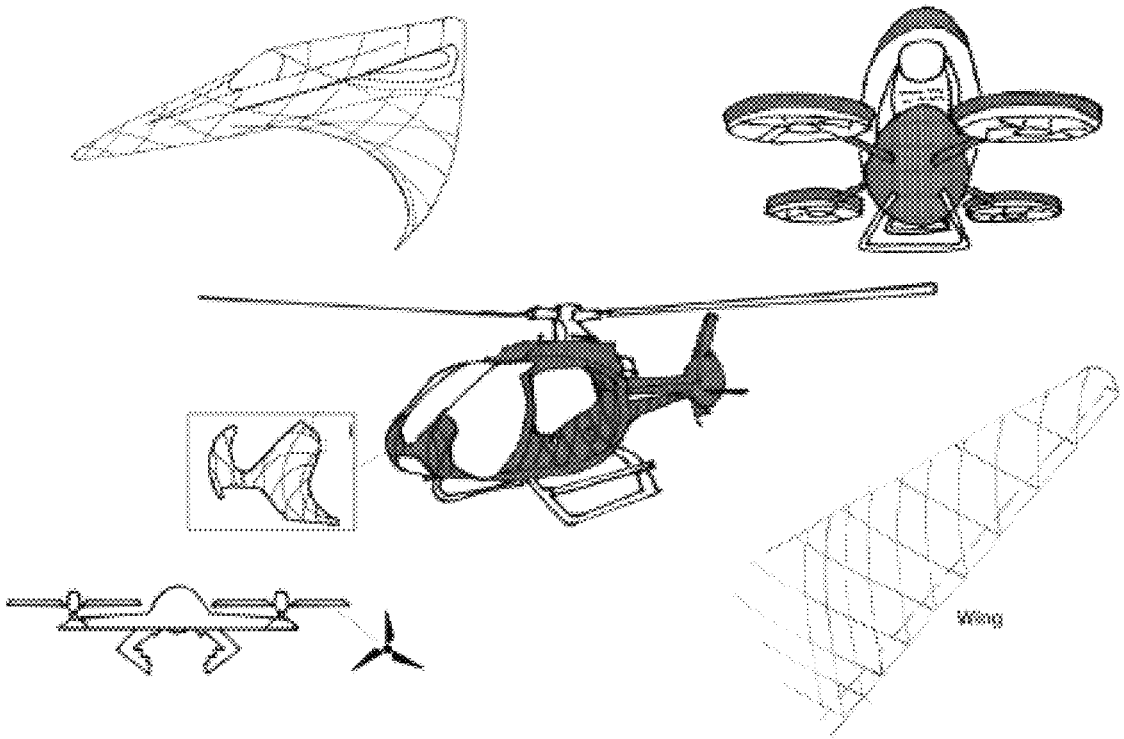
FIG. 25 shows exemplary fiber reinforced structures using weft knit warp in an aerospace application in accordance with an embodiment of the present disclosure.

FIG. 25 shows exemplary fiber reinforced structures using weft knit warp in an aerospace application in accordance with an embodiment of the present disclosure, where the warp structures are placed in selected locations providing various performance characteristics, including but not limited to vibration dampening, reinforcement, conductivity, auxetic characteristics, thermal shock dampening.

Figure 26:
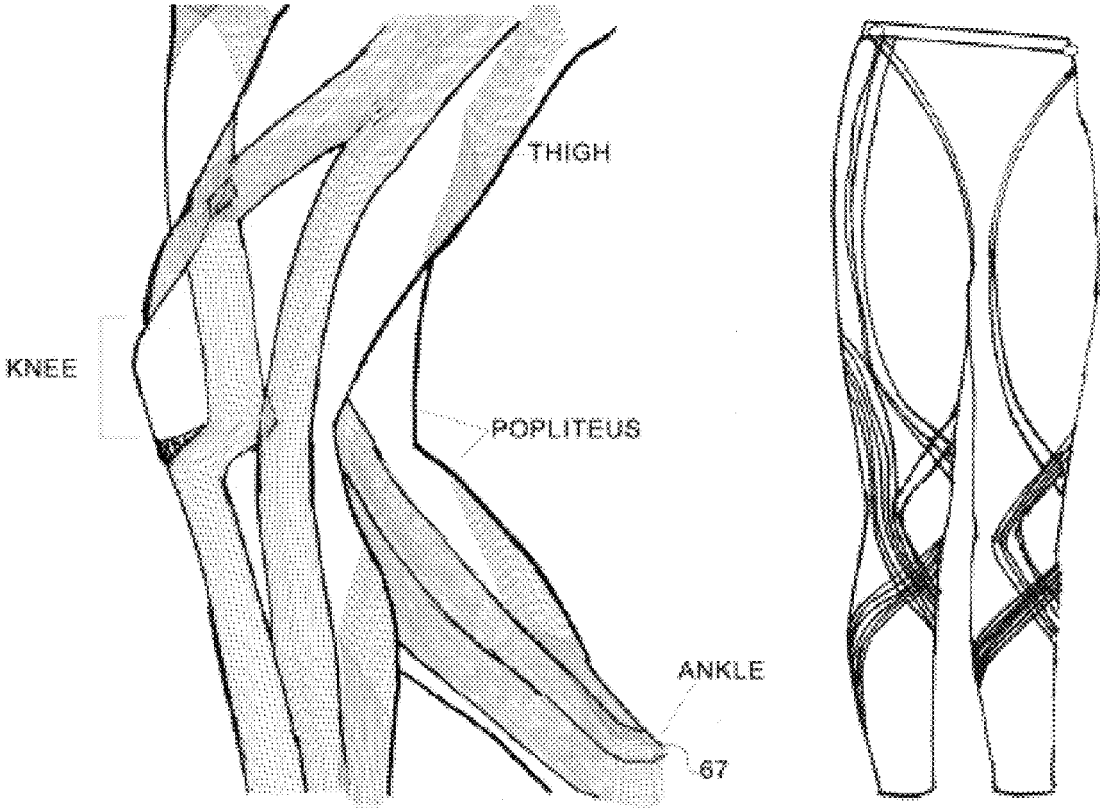
FIG. 26 demonstrates four groups of warp structures working together in an exemplary unitary orthopedic pant construction where the warp structures are placed in selected locations to provide support to the leg ligaments in accordance with an embodiment of the present disclosure.

FIG. 26 demonstrates four groups of warp structures working together in an exemplary unitary orthopedic pant construction where the warp structures are placed in selected locations to providing various performance characteristics, including but not limited toe supporting leg ligaments, auxetic characteristics, muscle vibration dampening, kinesio performance characteristics, etc. in accordance with an embodiment of the present disclosure. The exemplary pant legs may be knitted as a right structure and left structure and may be seamed at the crotch area. The garment may also be knitted as a seamless garment. The warp strands overlap at strategic points amplifying support and or other characteristics and meet at the waist band where they may be controlled by a warp strand tensioning device. Ends of corresponding strands may be spliced together at the back of the ankle 67 or for stirrup type leggings. The splice may be under the foot. The knitted construction may have a single layer or a configuration with multiple layers, layer portions, appendage components, and/or plies. The construction may also have fully-shaped appendage elements and/or liner areas receiving the weft knit warp guided material, where the entire construction and/or component is completely fashioned to shape by the machinery, with no cutting of the main body or component layers, layer portions, appendage components, and/or plies. There may be one or more strands of an adhesive material knitted, tucked, and/or plaited with the warp guide onto on the face and/or reverse sides, and/or internally of adjacent layers, layer portions, appendage components, and/or plies. There may be one or more strands of a restrictive ligament material knitted, tucked, and/or inlaid with the warp guide onto on the face and/or reverse sides, and/or internally of one or more layers, layer portions, appendage components, and/or plies. When plied, the layers, layer portions, appendage components, and/or plies are fixed in place as part of a unitary construction.

Figure 27:
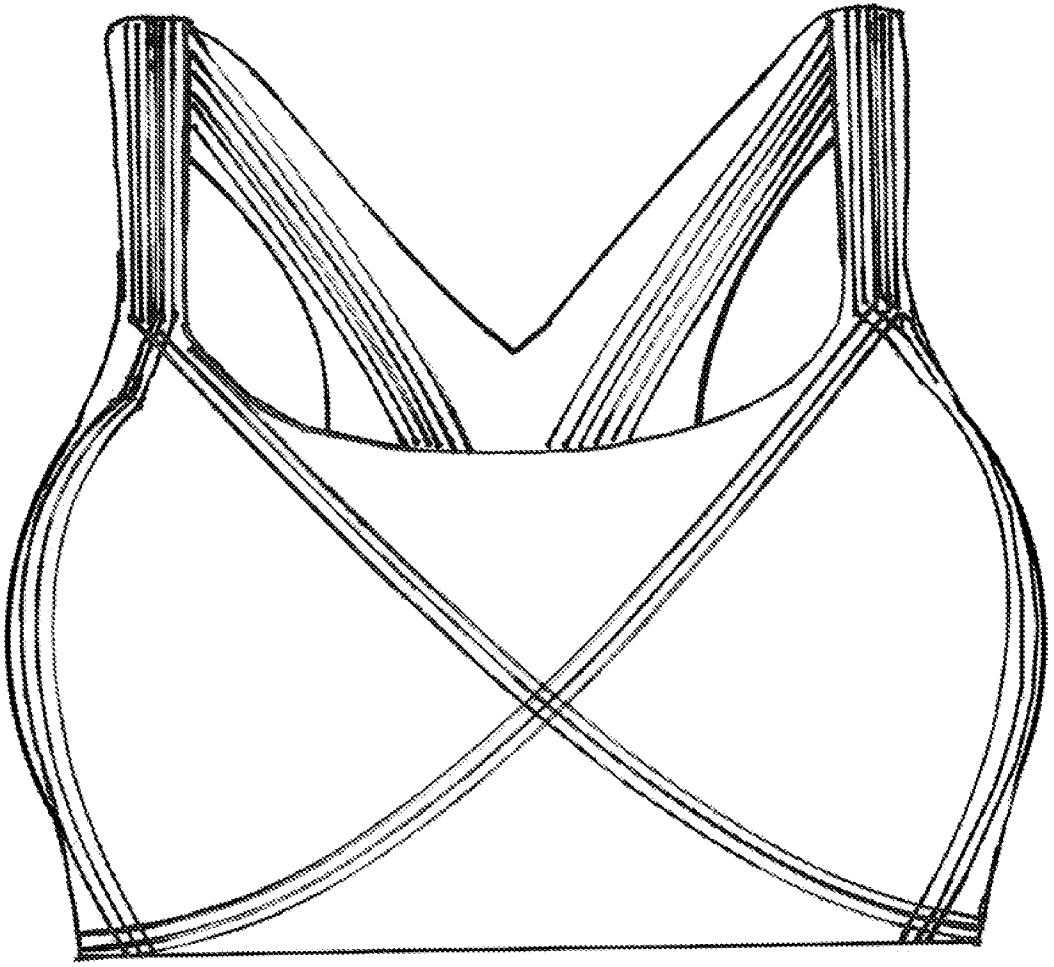
FIG. 27 demonstrates four groups of warp structures in an example unitary bra construction where the warp structures are strategically placed in selected locations to provide support to the connective tissue that supports breasts in accordance with an embodiment of the present disclosure.

There may be one or more strands of a stretch and recovery ligament material knitted, tucked, and/or inlaid with the warp guided onto on the face and/or reverse sides and/or internally of adjacent layers, layer portions, appendage components, and/or plies forming compression and/or amplified stretch zones. When plied, the layers, layer portions, appendage components, and/or plies are fixed in place as part of a unitary construction. FIG. 27 demonstrates four groups of warp structures in an exemplary unitary bra construction where the warp structures are strategically placed in selected locations to providing various performance characteristics, including but not limited to muscle vibration dampening, support to the connective tissue that supports breasts (e.g., Cooper's ligaments) in accordance with an embodiment of the present disclosure. The warp strands can move with the body and complement the movement while adding support.

According to embodiments of the present disclosure, there is no need for a separate sub-assembly process of adding a warp structure. The base fabric, the warp structure, and any componentry and/or adhesive material can be incorporated consistently, and the integration repeated automatically in production by the machine's pre-programmed system.

Figure 28:
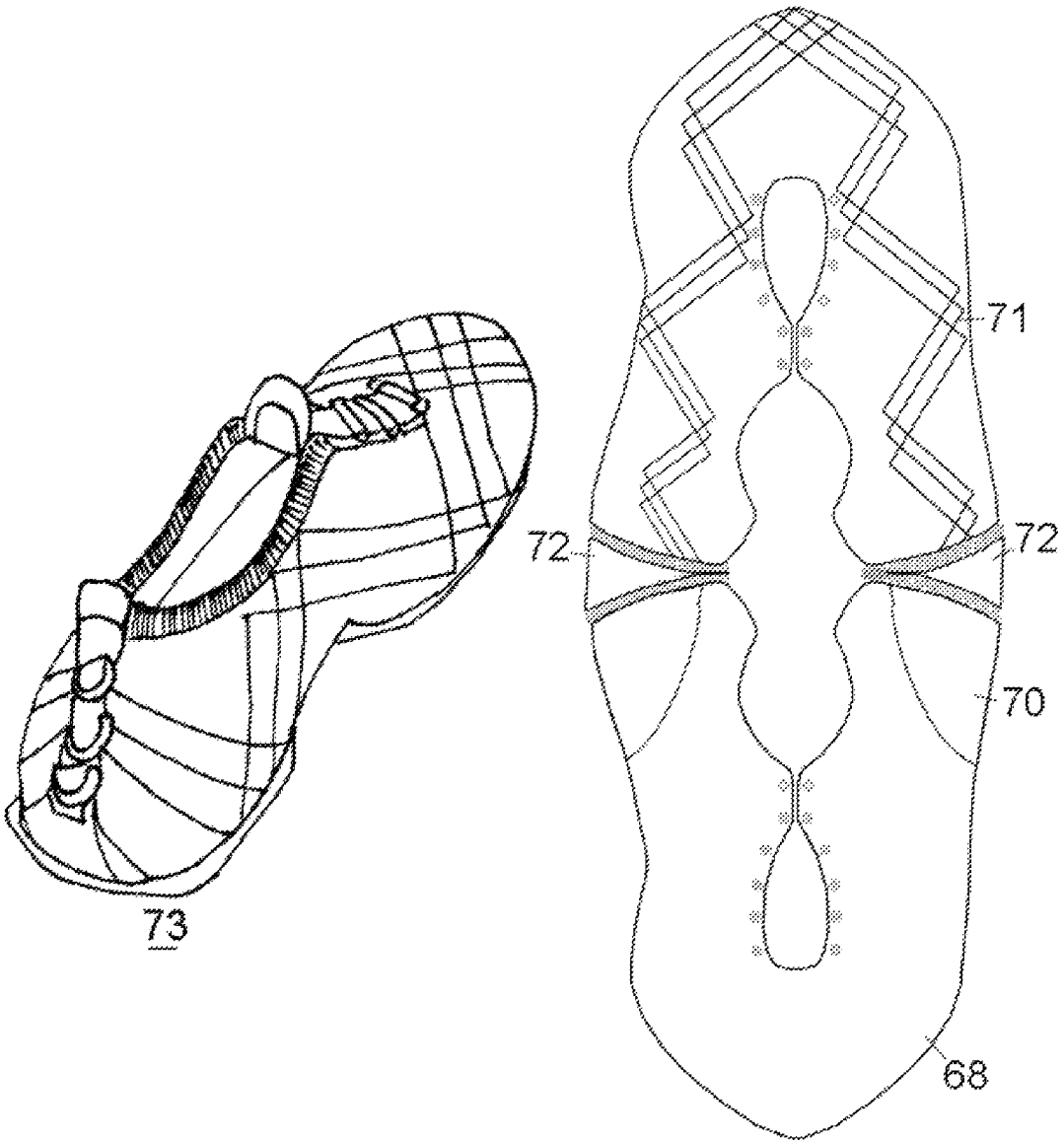
FIG. 28 demonstrates an exemplary footwear upper assembly with a functional interior liner which includes an exemplary moisture wicking base fabric and a TPU yarn in accordance with an embodiment of the present disclosure.

FIG. 28 demonstrates an exemplary footwear upper assembly with a functional interior liner which includes an exemplary moisture wicking base fabric 68 and a TPU yarn in accordance with an embodiment of the present disclosure. The functional interior liner contains a certain percentage of TPU yarns. If knitted on a multi-gauge V-bed knitting machine, this layer's stitch density can be half as dense as the attached outer layer's fabric to reduce weight, and create ventilation. Once the TPU yarns melt as an adhesive, the assembly of the interior layer and the outer layer are bond together. The pocket area 70 in the heel can receive an insert component. This layer 68 is not strong enough by itself to hold a foot in motion. The outer layer may be a more dense material construction for aesthetic and functional purposes or a light weight structure. The warp strands 71 traveling in strategic directions add strength to the layer. A group of weft knit warp strands travel multi-directionally as a group 71, being arranged anatomically mathematically and proportionally from the toe dart through the mid foot, medial and lateral ankle areas to the heel of the second layer. The two layers are attached by a dynamic waste section 72. The two layers, when pressed together like a "clam," assembled and heated in the shoe making process, create a strong light weight shoe upper 73 that is also comfortable.

Figure 29:
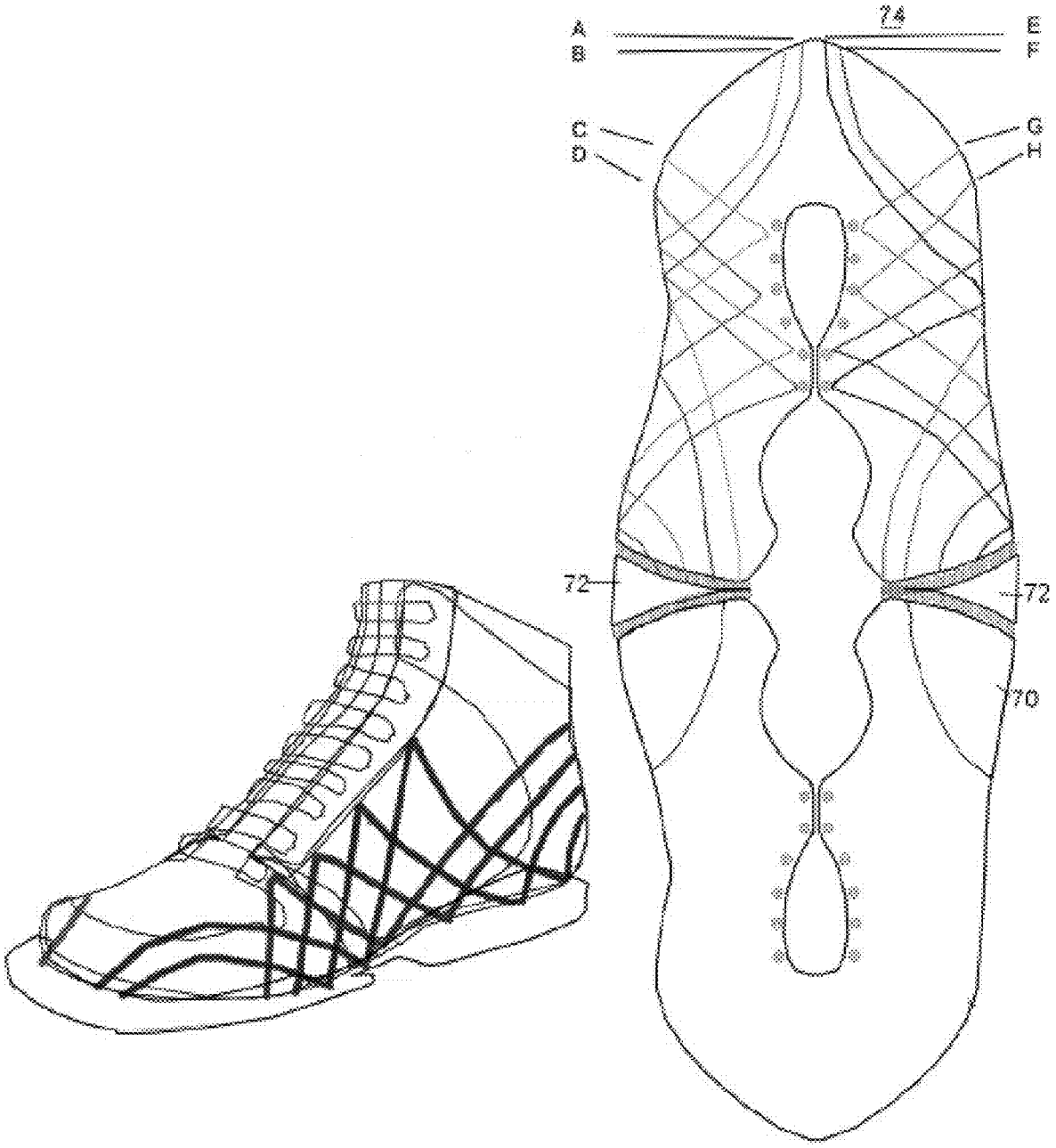
FIG. 29 shows an exemplary shoe upper with reinforcement warp strands traveling in strategic independent directions in accordance with an embodiment of the present disclosure.

FIG. 29 shows an exemplary shoe upper with reinforcement warp strands traveling in strategic independent directions in accordance with an embodiment of the present disclosure. In FIG. 29, eight individual weft knit warp strand structures (A through H) travel multi-directionally, but separately 74 arranged anatomically mathematically and proportionally from the toe dart through the mid foot, medial and lateral ankle areas to the heel of the second layer. This weft knit warp arrangement may for example help prevent ankle rollover for side-to-side lateral sports movements. The base material in this layer may be a polyester strand plaited on the reverse face with a low temperature melt polymer, such as PPS (Polyphenylenesulfide). When heated, the PPS stitches blend together on the back of the fabric creating a barrier to liquids. The two layers are attached in the knitting process by a dynamic waste section 72. The two layers, when pressed together, assembled and heated in the shoe making process, create a strong light weight shoe upper that is also comfortable.

The interior liner includes a moisture wicking base fabric and a percentage of TPU yarn. When plied together, the assembly results in a strong upper with reinforcement to assist in ankle roll over. The double layer assembly layout is extremely versatile. In a different configuration, the layer-based materials could be switched, and the layer with the weft knit warp strand structures are placed on the interior of the shoe where not visible to the wearer. The interior layer may have the PPS, optionally with some strategically placed pointelle holes for ventilation. The other layer may contain the TPU and polyester, where the polyester is arranged in an aesthetic design optionally including jacquard, texture, welt, intarsia, or any combination of aesthetic or functional elements. In this example there are eight strands (A through H) however, there may be as many strands as the machine systems will allow.

Embodiments of the present disclosure offer several advantages. First, the disclosure allows a plurality of performance features to be implemented simultaneously in the knitting process. Second, the disclosure allows various materials to be knitted consistently into the same layers, layer portions, appendage components, and/or plies as a unitary construction. Third, the disclosure allows each layer, a layer portion, an appendage component, and/or a ply to have a specific performance focus. Fourth, the disclosure allows the integration of many materials that would otherwise require additional sub-assembly. Fifth, the device allows for integration of fiber reinforcing materials, stretch ligament, conductive materials and other combinations of materials in weft and warp structures that may or may not be seen or otherwise perceived by the user. Sixth, the disclosure provides warp structures that can be configured as integrated sub-assembly components as in the case of embedded wiring, fiber optics, silicon, ligament structures, for instance.

In some embodiments, the knitting machine may be programmed or otherwise automatically controlled to generate individual self-contained fabrications utilizing one or more weft knit warp structures, or a daisy-chained strip of fabrications utilizing one or more weft knit warp structures, e.g., including first, second, third and more complete fabrications utilizing one or more weft knit warp structures, each knitted in any manner similar to that described above.

As an example, the machine may knit first fabrications utilizing one or more weft knit warp structures, second fabrications utilizing one or more weft knit warp structures, and third fabrications utilizing one or more weft knit warp structures, or any other number of fabrications utilizing one or more weft knit warp structures. In some embodiments, each of the fabrications utilizing one or more weft knit warp structures may be different from the patterns of the respective subsequent fabrications utilizing one or more weft knit warp structures. Of course, the patterns may be changed to be similar to those of the respective initial fabrications utilizing one or more weft knit warp structures if desired.

Further, in some embodiments, the knitting machine, or other automated panel assembly machine, may be controlled by a computerized controller to produce the daisy-chained strip of fabrications utilizing one or more weft knit warp structures. The controller may be any conventional processor, computer or any other suitable computing device. The controller may be electrically coupled to the machine, and may be in communication with a memory, a data storage module, a network, a server, or other devices that may store and/or transfer data. That data may represent a profile related to fabrications utilizing one or more weft knit warp structures. For example, the profile may be a first fabrication utilizing one or more weft knit warp structure data pertaining to one or more particular knitting patterns or other patterns associated with and/or incorporated into the fabrication utilizing one or more weft knit warp structures. The fabrications utilizing one or more weft knit warp structure's data may be implemented, accessed and/or utilized by the machine, in the form of a code, program and/or other directive. The fabrication utilizing one or more weft knit warp structure's data, when utilized to form the fabrications utilizing one or more weft knit warp structures with the assembly machine, ultimately may generate in the fabrication utilizing one or more weft knit warp structure, features such as: a predefined dimensional shape; the position, dimension and/or depth of a specific area of a fabric structure; the position of an apex and compound curve of the fabric panel; the length and location of an aperture, the position and dimension of various edges and calibration marks for assembly to the interior three-dimensionally knitted components; the minimum and maximum width and length of the fabrication utilizing one or more weft knit warp structure; placement of the one or more weft knit warp structures on the face, reverse or interior elements; embedded elements, and the like.

In some embodiments, a user preference profile can be automatically generated by scanning from a model, scanning from a body scanner. The scanned data is then interpreted from a point cloud, input manually, or otherwise digitally gathered and combined with the fabrications utilizing one or more weft knit warp structure's programming data by the V-bed knitting machine or computer coupling system. A user, utilizing a controller or other electronic system may utilize the data from the point cloud in combination with user preference file and digital fabric designs can direct where the warp structure are located on the fabric as the proportions of an article change with the user's input data, size and configuration preferences, creating the desired user input data. A set of parameters in a fabric configuration containing one or more weft knit warp structures may also be automatically reconfigured by a controller or other electronic system, utilizing the data from a user's body scan point cloud to directly create changes to the original fabric parameters mathematically and proportionally to achieve a customized set of input data. The V-bed knitting machine or computer coupling system can automatically convert user input data into the form of code or set of data codes to configure the user's desired modifications to the original fabrication by utilizing one or more weft knit warp structure's computerized knitting program. A central controller or other processing device may interpret the raw data, scan, or point cloud and reduce the data to machine code readable by the knitting machine. The v-bed machine accesses the converted data code to generate knitting production instructions, which are then accessed and executed by the V-bed knitting machine to create one or more desired customized aesthetic variations and/or customized functional variations of the original fabrication by utilizing one or more weft knit warp structures.

The central controller and/or the automated vehicle panel knitting machine may access the fabrication utilizing one or more weft knit warp structure's data to control the knitting machine and produce a strip of fabrications utilizing one or more weft knit warp structures, sequentially, in a desired number and configuration. Each of the fully shaped three-dimensional vehicle panels may include a substantially identical predefined three-dimensional shape, and may have virtually identical physical features, such as those enumerated above in connection with the fabrications utilizing one or more weft knit warp structures data. Alternatively, where the machine is set up to produce only a single fabrication utilizing one or more weft knit warp structures, the machine may be controlled by the central controller, which may utilize the fabrications utilizing one or more weft knit warp structure's data to produce a fabrication utilizing one or more weft knit warp structures, having features that correspond to the first fabrication utilizing one or more weft knit warp structure's data.

In turn, a user may experiment with those different fabrications utilizing one or more weft knit warp structure profiles, such as sizes, dimensions, gauges and/or styles, and select the one that best suits their preferences for assembly. In addition, if a user has a particular preferred fabrication utilizing one or more weft knit warp structures, that profile of a particular fabrications utilizing one or more weft knit warp structures may be stored in a database. When the user damages their first fabrication utilizing one or more weft knit warp structures, they may request another fabrication utilizing one or more weft knit warp structures, identical to the first fabrication utilizing one or more weft knit warp structures, and it is produced again. Thus, the user may start again with virtually the same fabrication utilizing one or more weft knit warp structures and associated feel as they had with the previous fabrication utilizing one or more weft knit warp structures. This may enhance the experience of the user and of the manufacturer, since no parts need to be inventoried or stored. Also, the manufacturer need not go through an extensive selection process and time period to locate a fabrication utilizing one or more weft knit warp structures that performs as desired. Instead, upon purchase of the new fabrication utilizing one or more weft knit warp structures combination, the fabrication utilizing one or more weft knit warp structures will be produced on-demand, and consistently perform as expected for the user. In some embodiments, the fabrication utilizing one or more weft knit warp structures may have aesthetic designs or jacquard knitted into the main body. These designs or jacquards may be customized by the user, and subsequently knitted by the machine.

Although certain preferred embodiments and methods have been disclosed herein, it will be apparent from the foregoing disclosure to those skilled in the art that variations and modifications of such embodiments and methods may be made without departing from the spirit and scope of the invention. It is intended that the invention shall be limited only to the extent required by the appended claims and the rules and principles of applicable law.

What is claimed is:

1. A knitting process of producing a textile article using a knitting machine to introduce at least one warp structure, the knitting process comprising:

knitting a first set of strands that results in a weft knitted fabric base that comprises weft strands, while simultaneously during the knitting process, introducing one or more second strands for attaching or embedding the one or more second strands into the weft knitted fabric base using a knitting machine feeder for creating the at least one warp structure;

wherein the introducing of the one or more second strands for the creating of the at least one warp structure comprises:

raising selected needles on the knitting machine to a warp height using a warp guard cam;

carrying the one or more second strands in feeder tips of the knitting machine feeder to the selected needles;

lowering the knitting machine feeder to the warp height and laying the one or more second strands into hooks for the selected needles; and creating the at least one warp structure using the selected needles;

wherein the at least one warp structure is formed by knitting, floating, tucking and/or inlaying the one or more second strands in the knitting process, wherein at least one strand of the one or more second strands is held in the weft knitted fabric base by weft knitted stitches that are generated in the knitting process, wherein the first set of strands comprises one or more strands.

2. The knitting process of claim 1, wherein multiple strands in the at least one warp structure are spaced apart from each other in a horizontal direction and disposed between the weft strands of the weft knitted fabric base, and wherein the multiple strands in the at least one warp structure extend in a weft direction between adjacent stitch wales of the weft knitted fabric base.

3. The knitting process of claim 1, wherein the one or more second strands are held in the weft knitted fabric base by the first set of strands that are generated in the knitting process.

4. The knitting process of claim 1, wherein the one or more second strands are warp strands, and wherein the at least one warp structure is a laid-in warp and comprises:

a first section of laterally spaced-apart warp strands;

at least one second section of laterally spaced-apart warp strands; and at least one third section of laterally spaced-apart warp strands that are integrated to intersect, connect to, frame, and/or otherwise interact with any warp strands of the first section;

wherein the first, second and third sections are held together by the first set of strands, wherein the warp strands of the first, second and third sections have an interlaced appearance attached to the weft knitted fabric base.

5. The knitting process of claim 4, wherein the at least one warp structure further comprises at least one additional section of laterally spaced-apart warp strands that are integrated to intersect, connect to, frame, and/or otherwise interact with any of the warp strands of the second and third sections.

6. The knitting process of claim 1, wherein the introduced at least one warp structure forms one or more of: a ligament in stretch; a muscle vibration dampening structure; a restrictive structure; thermal shock dampening; auxetic structure; and/or a conductive structure.

7. A knitting process of producing a textile article using a knitting machine to introduce at least one warp structure, the knitting process comprising:

knitting a first set of strands that results in a weft knitted fabric base using the knitting machine, and while at the same time and in the same knitting process, introducing one or more second strands by attaching or embedding the one or more second strands in the weft knitted fabric base, and forming the one or more second strands by knitting, tucking, inlaying and/or floating the one or more second strands by using the knitting machine thereby creating the at least one warp structure wherein the creating of the at least one warp structure comprises:

raising selected needles on the knitting machine to a warp height using a warp guard cam;

carrying the one or more second strands in feeder tips of the knitting machine to the selected needles; and lowering the feeder tips of the knitting machine towards the selected needles and laying the one or more second strands into hooks for the selected needles;

wherein at least one strand of the one or more second strands is held in the weft knitted fabric base by loops and/or underlap of weft knitted course and/or wale stitches that are generated in the knitting process.

8. The knitting process of claim 7, wherein the knitting of the at least one warp structure comprises using at least one weft knit warp feeder assembly to hold the one or more second strands to interface with one or more knitting needles and one or more needle beds of a weft knitting machine of the knitting machine.

9. The knitting process of claim 8, wherein the using of the at least one weft knit warp feeder assembly further comprises moving the at least one weft knit warp feeder assembly by a predetermined number of needle steps of the weft knitting machine.

10. The knitting process of claim 9, further comprising positioning the at least one weft knit warp feeder assembly into a swing position such that at least a portion of the one or more second strands are placed into the hooks of the one or more knitting needles of the weft knitting machine of the knitting machine to create a knit loop, a float, a tuck, and/or an inlay structure.

11. The knitting process of claim 10, wherein the moving of the at least one weft knit warp feeder assembly by the predetermined number of needle steps of the weft knitting machine comprises moving the at least one weft knit warp feeder assembly in a first direction followed by moving the at least one weft knit warp feeder assembly in a second direction that is independent from the first direction.

12. A knitting process of producing a textile article using a knitting machine to introduce at least one warp structure, the knitting process comprising:

knitting a first set of strands that results in a weft knitted fabric base using the knitting machine; and simultaneously with the knitting of the first set of strands, knitting the at least one warp structure using at least one second set of strands by using a weft knit warp feeder of the knitting machine, wherein the at least one second set of strands is held in the weft knitted fabric base by loops and/or underlaps of weft knitted wale and course stitches that are generated in the knitting process, wherein the knitting of the at least one warp structure comprises:

raising selected needles on the knitting machine to a warp height using a warp guard cam;

carrying the at least one second set of strands in feeder tips of the knitting machine to the selected needles;

lowering the feeder tips of the knitting machine towards the selected needles and laying the at least one second set of strands into hooks of the selected needles; and creating the at least one warp structure using the selected needles.

13. The knitting process of claim 12, wherein the knitting of the first set of strands into the weft knitted fabric base using the knitting machine comprises knitting a plurality of stitch courses that extend in a vertical direction, the plurality of stitch courses having a plurality of substantially parallel wales and the knitting of the at least one warp structure comprises guiding the weft knit warp feeder horizontally, vertically, and/or diagonally over the plurality of stitch courses that extend in the vertical direction thereby creating at least one warp structure element that extends in at least one direction, over the plurality of stitch courses, while simultaneously, creating the weft knitted fabric base in the same knitting process.

14. The knitting process of claim 12, wherein the knitting of the at least one warp structure using the at least one second set of strands by using the weft knit warp feeder of the knitting machine comprises knitting a first warp structure and a second warp structure, wherein the knitting of the first warp structure overlaps at least a portion of the second warp structure.

15. The knitting process of claim 12, wherein the knitting of the first set of strands into the weft knitted fabric base comprises knitting the weft knitted fabric base into a plurality of layers and the knitting of the at least one warp structure comprises traversing between a first layer of the plurality of layers and a second layer of the plurality of layers.

16. The knitting process of claim 12, wherein the knitting of the first set of strands that results in the weft knitted fabric base comprises knitting the weft knitted fabric base into a plurality of layers, the plurality of layers comprising a first layer, a second layer, and a third layer, the second layer being disposed between the first layer and the third layer, wherein the knitting of the at least one warp structure comprises knitting a first portion of the at least one warp structure in the second layer, traversing to another location on the second layer, and knitting a second portion of the at least one warp structure at the other location of the second layer.

17. The knitting process of claim 12, wherein the knitting of the at least one warp structure using the at least one second set of strands further comprises integrating one or more specialized strands into a plurality of weft knit warp structures in the weft knitted fabric base, a given one of the plurality of weft knit warp structures in the weft knitted fabric base being laterally spaced from another one of the plurality of weft knit warp structures in the weft knitted fabric base.

18. The knitting process of claim 12, wherein the knitting of the first set of strands into the weft knitted fabric base comprises knitting the weft knitted fabric base into a single layer in a first portion of the textile article and knitting the weft knitted fabric base into a plurality of layers in a second portion of the textile article and the knitting of the at least one warp structure comprises integrating the at least one second set of strands into the first portion and/or the second portion so as to improve upon an aesthetic or performance characteristic for the textile article.

19. The knitting process of claim 12, wherein the knitting of the at least one warp structure using the at least one second set of strands further comprises knitting the at least one warp structure such that the at least one warp structure interacts with other integrated structures of the textile article.

20. The knitting process of claim 12, wherein the knitting of the at least one warp structure using the at least one second set of strands further comprises traversing from one face of the weft knitted fabric base to another face of the weft knitted fabric base.

21. The knitting process of claim 12, wherein the knitting of the at least one warp structure using the at least one second set of strands further comprises integrating the at least one second set of strands into a three-dimensional shape to improve a performance characteristic for the textile article as compared with a textile article that does not integrate the at least one second set of strands into the three-dimensional shape.

* * * * *